US011325014B2

(12) United States Patent
Phelan, Jr.

(10) Patent No.: US 11,325,014 B2
(45) **Date of Patent: *May 10, 2022**

(54) ERGONOMIC GRIP SLEEVE FOR SPORT STICKS

(71) Applicant: PROXR, LLC, Kirkwood, MO (US)

(72) Inventor: Gerald Leo Phelan, Jr., St. Louis, MO (US)

(73) Assignee: PROXR, LLC, Kirkwood, MO (US)

( * ) Notice: Subject to any disclaimer, the term of this patent is extended or adjusted under 35 U.S.C. 154(b) by 10 days.

This patent is subject to a terminal disclaimer.

(21) Appl. No.: 17/101,928

(22) Filed: Nov. 23, 2020

(65) Prior Publication Data

US 2021/0128999 A1 May 6, 2021

Related U.S. Application Data

(63) Continuation of application No. 15/325,812, filed as application No. PCT/US2015/039956 on Jul. 10, 2015, now Pat. No. 10,898,772.

(60) Provisional application No. 62/023,943, filed on Jul. 13, 2014.

(51) Int. Cl.

| | |
|---|---|
| ***A63B 53/14*** | (2015.01) |
| ***A63B 60/14*** | (2015.01) |
| ***A63B 60/12*** | (2015.01) |

(52) U.S. Cl.

CPC ..... *A63B 60/14* (2015.10); *A63B 60/12* (2015.10); *A63B 2209/00* (2013.01)

(58) Field of Classification Search

CPC ..... A63B 60/06; A63B 60/12; A63B 60/14; A63B 2209/00

See application file for complete search history.

(56) References Cited

U.S. PATENT DOCUMENTS

| | | | | |
|---|---|---|---|---|
| 3,868,110 | A | 2/1975 | Jones | |
| 3,905,598 | A | 9/1975 | Ballog | |
| 4,351,528 | A | 9/1982 | Duplin | |
| 4,696,842 | A | 9/1987 | Doubt | |
| 4,828,261 | A | 5/1989 | Kleylein | |
| 6,148,483 | A | 11/2000 | DeGraff | |
| 6,419,601 | B1 | 7/2002 | Kenner | |
| 6,500,079 | B1 | 12/2002 | Tucker, Sr. | |
| 7,276,000 | B1 | 10/2007 | Baker | |
| 7,744,497 | B2 | 6/2010 | Phelan, Jr. | |
| 8,292,762 | B2 | 10/2012 | Clancy | |
| 10,898,772 | B2 * | 1/2021 | Phelan, Jr. | A63B 60/14 |
| 2004/0147346 | A1 | 7/2004 | Casasanta | |
| 2008/0032832 | A1 | 2/2008 | Thomas | |
| 2008/0200288 | A1 | 8/2008 | Phelan | |

(Continued)

OTHER PUBLICATIONS

Patent Cooperation Treaty, International Search Report for PCT/US15/39956, dated Oct. 16, 2015, 4 pages.

*Primary Examiner* — Raleigh W Chiu

(74) *Attorney, Agent, or Firm* — Marshall, Gerstein & Borun LLP

(57) ABSTRACT

A sleeve adapted for receiving the solid or hollow end of a sports stick. The sleeve has dorsal and ventral cantle regions each providing a curved support surface for the hand of the athlete when the athlete is gripping the sports stick. The dorsal cantle region and the ventral cantle region each have a radius of curvature in the sagittal plane wherein the radius of curvature of the ventral cantle region is greater than the radius of curvature of the dorsal cantle region.

20 Claims, 25 Drawing Sheets

(56) References Cited

U.S. PATENT DOCUMENTS

| | | | |
|---|---|---|---|
| 2010/0151975 | A1 | 6/2010 | Hisle et al. |
| 2017/0106262 | A1 | 4/2017 | Long et al. |
| 2017/0165548 | A1 | 6/2017 | Phelan, Jr. |
| 2017/0182388 | A1 | 6/2017 | Long et al. |
| 2018/0079065 | A1 | 3/2018 | Peng |

* cited by examiner

ERGONOMIC GRIP SLEEVE FOR SPORT STICKS

CROSS REFERENCE TO RELATED APPLICATIONS

This application claims the benefit of U.S. application Ser. No. 15/325,812, filed on Jan. 12, 2017, which is the U.S. National Phase of International Patent Application No. PCT/US105/39956, having an international filing date of Jul. 10, 2015, and which claims the benefit of priority of U.S. Application No. 62/023,943, filed Jul. 13, 2014. The entire contents of each of the foregoing is expressly incorporated herein by reference.

FIELD OF THE DISCLOSURE

The present disclosure generally relates to a gripping sleeve which is applied to the gripping end of a sport swinging implement having a solid or hollow stick, shaft or handle. Said sleeve can be made from materials having elastic or elastomeric attributes and slipped on to the gripping end of a swinging implement or can be molded from various self-curing materials directly to the gripping end of a swinging sports implement. In one embodiment, the disclosure relates to a sleeve for attachment to the end of a solid or hollow shaft of a sports stick, for example, the hollow shaft of a hockey stick, a lacrosse stick, a baseball bat, a softball bat, a cricket bat or a golf club. The present disclosure also relates to a sleeve with a hollow cavity that is applied to the gripping end of swinging implements which are hollow sticks, shafts or handles.

BACKGROUND

Swinging implements, those with a handle that are grasped in the hand(s) and swung with a greater arm motion, date back many thousands of years. These implements, known as "simple machines," were born out of the need for survival, e.g., hunting and protection. Over the last 8,500 years they have evolved into hammers, axes, swords and other tools. Early swinging implements of the tool and weapon variety are distinguished by the way they are swung by the user, specifically, those implements are swung a linear swing path, which ends at the point of contact. The "linear path swing" mandates that the hand(s) stay behind the center axis of the implement throughout the entirety of the swing and not deviate from the linear path.

The vast majority of swinging implements through time and today have evolved an oval shaped handle. This oval shape, when gripped, delivers a crucial benefit to the user in that the oval shape keeps the structures (carpal, metacarpal and phalanx bones) of the hand(s) and wrist locked in alignment with the linear path of the swing resulting in a more accurate delivery of the implement to the targeted object of contact. Not until the recent advent of sports did the swing path and thus the swinging implement necessitate change.

Some forms of stick and ball games date back to 12th century in Ireland and are the precursor to modern game of Hurling. In the 13th century the English started swinging an implement or stick with a contact structure to strike a ball to drive it to a target—the earliest form of golf. For the first time in human history the swing of an implement no longer ended at the point of contact, but rather, the implement had to be swung through the point of contact. To achieve this, the path of the implement must rotate roughly around the central axis the body of the person performing the swing. Specifically, after swinging the implement to and through the intended targeted object, the implement must continue around the body, thus the hands must pass over the central longitudinal axis of the implement to allow the implement to continue its rotational path around the body.

This new swing motion allows the collective energy generated by the swing to be imparted, with speed and power through the targeted object, i.e., a puck or ball, and allow the momentum generated before contact to diminish in speed and force—thus was born the "rotational-swing." A rotational-swing can be observed in sports like, golf, cricket, baseball, softball, hockey and others. When performed with the greater collaboration of the shoulders, body and legs, the rotational-swing creates a whole new set of coordinated motions, steps, grips and swinging implements that continue to evolve in all sports today. The greater rotational and linear swings and related paths discussed here are not to be confused with rotational and linear "swing techniques" taught in some sports.

For most sports, the oval shape grip and handle of the linear-path swinging implement is ill-equipped to serve the required dynamics of a rotational swing. Because the oval shaped grip and handle restricted the path of the hand(s) during a swing to a linear swing path, the rotational-swing path is best served by a round or generally rounded grip and/or handle. As the more round the handle/grip the more easily the hand(s) can pass over the central axis of the implement to perform and complete a rotational-swing path.

When an athlete grasps a sports implement with the hands, it is referred to as "the power grip"—with the handle or grip being fully or mostly wrapped with the fingers & palm and opposed by the thumb. During a rotational-swing path, immediately after the intended point of contact, the hand(s) is forced through a rapid ulnar flexion or bending of the wrist to the pinky side of the hand to navigate over the central longitudinal axis of the implement to complete the swing—for this analysis, this moment is referred to as the "transitional phase" of a rotational swing path. As with all rotational swings, compression and friction forces peak in the area of the hypothenar as the hand(s) pass over the central axis of the swinging implement. This is a current and common problem as evidence of these forces is seen in the wear and tear that occurs in the palmer area, specifically the area of the hypothenar, of gloves worn by athletes in golf, baseball, hockey, lacrosse and others. Additional evidence of excessive transitional-phase compression can be found in many orthopedic medical journals—the occurrence of the broken hamate bone, or broken "hook-of-the-hamate" is the resulting injury. The hamate bone is located directly beneath the area of the hypothenar and its location is directly next to path where the ulnar nerve runs. Important to note that the ulnar nerve controls the small and ring fingers—both of which are critical to a firm, stable and productive grip. Both of these key structures for gripping are, by virtue of the rotational-swing, power grip and rapid ulnar flexion, vulnerable to excessive and destabilizing compression forces.

With a rotational swing, centrifugal forces pull the swinging implement away from the athlete and the athlete imparts centripetal force to the implement through the hand(s) to maintain grip and a rotation arch of the swing around the body. To prevent the sporting implement from slipping from that hand(s) during the rotational swing, many sporting implements have evolved to incorporate grip-stops or "knobs" of various shapes and sizes—baseball bats have rounded knobs, tangentially oriented to the center axis of the bat, at the end of the handle; golf club handle grips gently flare out at the end, hockey sticks commonly have various sizes of knobs made of tape on the end and lacrosse sticks have rubber or plastic plugs or knobs. Knobs incorporated in all sports swinging implements typically have the entirety of the knob being perpendicular in orientation to the center axis of the sports swinging implement. A perpendicularly-oriented knob, however, is not without its problems; it creates, in effect, a speed bump for the base gripping hand to overcome at the transitional phase of the swing.

To-date, some have endeavored to improve grip by creating angled handles and knobs that intentionally deviate from the central axis of the sports stick being swung. This approach, however, is counter-intuitive to the human experience of having the hands grip a swinging implement along a common central longitudinal axis of a stick. The key to accuracy and power in a rotational swing using a "power grip" is proper hand alignment with the central longitudinal axis of the swinging implement.

Other ergonomic handles and knobs have been components of greater swinging implements, e.g., tennis racket, baseball bats and others. And while these swinging implements deliver some grip and performance benefits, they do not address the specific structural aspects that occur with different kinds of hollow sticks.

When athletes initially grasp a sports swinging implement with their hand using the power grip, the hand is most typically perpendicular to the central axis of the implement and the contact between the hand and knob is evenly distributed from the hypothenar around the knob to the opposing grip of the small or pinky finger. But, during the transitional phase of the swing, the relationship between the knob and the hand changes dramatically. As the hand is forced over the central longitudinal axis of the swinging implement the hand undergoes rapid ulnar flexion resulting in the conventional knob forcefully compressing into the hypothenar area of the base gripping hand creating three major problems:

1. A "speed-bump" effect wherein the hand is un-naturally forced over the larger knob thus negatively impacting and slowing down the natural swing thus reducing accuracy, power and hand speed.
2. Compression to the ulnar nerve of the base gripping hand, which controls the grip of the pinky and ring fingers, causing potential momentary grip failure as evidenced by thrown bats in baseball and thrown clubs in golf.
3. Injuries like broken hamate bones, contusions, wrist strain and nerve damage all of which occur in the areas in and surrounding the hypothenar.

In evolutionary terms, the swinging implements used in sports, which require a rotational-swing, are roughly 700 years old—they're still in their formative years compared to their linear-swing-path cousins. As for the hockey stick, it's modern roots date back only to the late 1800s when hockey was first played in Canada—as such it's in its infancy of evolution.

Hockey sticks are composed of a straight, mostly rectangular in cross-section, shaft having a longitudinal central axis from the non-blade end of the stick to the point of attachment where the blade is affixed. A complete hockey stick features a flattened blade affixed at its end used to control (handle, pass, maneuver and contact) the puck. Hockey sticks are constructed of various materials—solid wood, aluminum, plastic, composite and more recently with carbon fiber materials resulting in very light and strong sticks with a hollow shaft.

To improve grip on the stick, players apply various kinds of tapes and grips along the length of the handle end of the stick. More recently, sticks have been manufactured with a "tacky" surface covering to enhance grip. A common practice among players taping their stick handle, is to create a "knob" on the end of the stick using multiple layers of tape. This practice has been in use for decades and varies with the personal preference of each player. This "knob of tape" aids players in keeping the stick in their hand during play and makes the stick easy to pick up off the ice if dropped.

The evolution of the hockey stick has resulted in the predominance of composite sticks made with resins and weaved fibers like fiberglass and carbon used in play. This type of structure has become the preferred standard stick design at virtually all playing levels of hockey. Now, with a hollow opening at the end of the stick, which is typically covered with a plastic or rubber plug, the hockey stick is capable of accepting an extension to lengthen the stick for greater leverage or, as per the knob described herein, an ergonomic knob to improve grip and for greater performance.

In some instances, rubber sleeves, which simply replicate the taping of the stick handle, are slipped over the ends of the sticks. This provides a similar solution to the taping but does not provide any additional benefit or support and may well create unwanted compression and resistance in handling the stick. The predominantly rectangular shape of the stick is not conducive to engaging the subtle shapes of the carpal arches of the gripping hand or the changes that occur in the relationship between the hand and the stick during the course of play where a rotational swing motion is constantly evident.

Of particular note, hockey players typically wear out their gloves in the palm (specifically the area of the hypothenar) area of their glove. This wear is the result of constant and considerable friction, compression and torque being applied through the glove by the hand to the stick and the knob of tape as the hand passes back and forth across the central axis of the stick.

Some of the solutions to address the gripping of a hockey stick which have been employed, include complete handles and grips, which in essence provide an separate grip structure or handle with which to grasp the end of stick. There are limited options for players to improve grip of their hockey stick—wrapping with tape, creating ridges of tape down the length of the handle or wrapped rotationally around the handle and full add-on handles. However, no solution provides an ergonomic knob that is a smooth extension of the stick which provides structures that support and engage the hand and that work with the changes that occur between the hand and the stick during play as outlined earlier. Therefore there is an unmet need for an effective, simple and elegant solution to enable hockey players to have a more natural and ergonomically correct grip and thus achieve a higher level of performance with their hockey stick through the use of the sleeve described herein.

Lacrosse sticks are composed of a straight handle, a generally elongated-octagonal cross-section shaft having a longitudinal central axis from the grip end of the handle, wherein one end is capped with a plug, with the other end being the point of attachment where the throat of the head is affixed to the handle. A complete lacrosse stick features the handle, rubber plug and a basket-like head with a net, comprised of a pocket and shooting string, made of heavy rope-like webbing. The head end of the stick is used to control (catch, cradle, block and pass) the ball. Lacrosse sticks are mostly constructed of various metals (aluminum) and some plastic and composite sticks are available—most handles feature a hollow shaft.

Lacrosse players, for the most part, carry the head of the stick above their waist, whereas hockey players utilize the blade of their stick below their waist. In lacrosse, players "cradle" the ball in the pocket, rolling the stick forward and backward in their hands during play to keep the ball fixed in the pocket. This constant movement of the stick in the hands generates friction and compression in the players hands. Lacrosse gloves are very similar to their larger and heavier padded cousins, the hockey glove, in that they too wear out in the same manor and place—through the power-grip area and over the hypothenar of the hand.

While the lacrosse shot is similar to a throwing motion, the principles of a rotational swing apply here, too. The hands cross over the center axis of the lacrosse stick in order to complete the shot. This generates compression forces in the hands during ulnar flexion.

Some of the same solutions used in hockey to address the gripping of a hockey stick have been employed in lacrosse and other hollow-stick implements, include wrapping with tape, creating ridges of tape down around the handle or wrapped rotationally around the handle. Lacrosse players have a wide variety of knobs from which to choose from with most or all said knobs having a perpendicular orientation to the center axis of the handle. However, no current knob or grip provides an ergonomic knob that is a smooth extension of the stick which provides structures that support and engage the hand and that works with the changes that occur between the hand and the stick during play as outlined earlier.

In regard to lacrosse, while this sport dates back centuries it is used to throw the ball rather than contact it, however many of the same rotational swing principles for gripping and swinging the stick apply. Similarly, much, if not all of the action imparted to a hockey stick via the hand(s), during puck-handling and shooting requires the hand to move back and forth across the central axis of the stick in a more subtle rotational swing path motion. The most pronounced example of a rotational-swing in hockey is the slap shot, wherein the stick is held behind the body then thrust forward until contact with the ice just behind the puck allows the stick to "load", through flex in the handle, then contact the puck. After contact with the puck has ended the player must roll the stick forward in the hands and around the body—a rotational-path-swing. The hockey stick is a rigid, rectangular structure, similar to that of a lacrosse stick, that when gripped and handled throughout use in play, delivers constant compression to the hypothenar area of the base gripping hand due to the very nature of the power-grip and rotational swing motion.

SUMMARY

Among the various aspects of the present disclosure is a sleeve for use in connection with a swinging implement that (i) provides a structure and/or surfaces that cradle and support the greater area of the hypothenar of the hand, (ii) distributes compressive forces across the greater area of the angled cantle-like flange to a broader area of the hand rather than focused on the hamate bone and ulnar nerve, (iii) provides improved contoured gripping structures for the pinky finger to improve overall grip stability throughout a rotational swing, (iv) provides increased effective surface area contact between the swinging implement and the hand across the various palmar arches of the hand resulting in greater swing control and precision, and/or (v) provides an angled, cantle-like flange to properly align with natural limited range of motion of the hand during ulnar flexion. Advantageously, therefore, the sleeve presented herein provides support, grip and performance.

Another aspect of the present disclosure is a sleeve for application with a solid or the hollow end of a metallic, polymeric or composite shaft of a sports stick. The sleeve comprises an outer sleeve that is applied over the outside of the gripping end of a solid or hollow end of a swinging implement adapted for to be grasped by the hand(s) of a user when the sleeve is fully applied to cover the outside gripping end of the swinging implement. In one embodiment, the sleeve comprises an oblique supporting structure, a transitional neck structure and a cavity within the neck for receiving the end of a sport stick.

Another aspect of the present disclosure is a sleeve for support and grip of the hand that includes an upper rounded oblique, cantle-like supporting structure. This ventral cantle-like structure is adapted to engage and cradle the heal of the gripping hand, more specifically the hypothenar of the gripping hand.

Another aspect of the present disclosure is a sleeve for support and grip of the hand that includes a lower rounded oblique gripping structure that engages the small finger of the hand. This dorsal cantle-like structure provides stable engagement structure for the small gripping finger of the gripping hand.

Another aspect of the present disclosure is a sleeve for support and grip of the hand that includes a generally oblique grip end flange that engages and supports the collective gripping structure of the hand extending from the little finger following along the palmer arches of the hand.

Another aspect of the present disclosure is a sleeve for support and grip of the hand that includes a generally oblique upper flange that engages and supports the collective gripping structure of the hand extending from the little finger following along the palmer arches of the hand which is obtusely angled in a range from 90 degrees to 160 degrees.

Another aspect of the present disclosure is a sleeve for support and grip of the hand that includes a generally oblique lower flange that engage and support the collective gripping structure of the hand extending from the little finger following along the palmer arches of the hand which is acutely angled in a range from 30 degrees to 89 degrees.

Another aspect of the present disclosure is a sleeve for support and grip of the hand that includes a shaft, which generally transitions the greater oblique flange structure to a reduced diameter cross-sectional shape that aligns the outer surrounding surface of the shaft with the longitudinal outer surface of the hollow stick, handle or shaft.

Another aspect of the present disclosure is a sleeve for support and grip of the hand that includes a cavity, which is sized to closely fit around the outside gripping end of the solid or hollow end of a stick, handle or shaft, thus properly securing the sleeve to the stick, handle or shaft.

Another aspect of the present disclosure is a sleeve for support and grip of the hand, wherein the flange-end of the sleeve is aligned to the central longitudinal axis of the sleeve, and terminates in an oblique rounded cylinder, which is generally parallel to the oblique angle of the flange structure.

Another aspect of the present disclosure is a sleeve for support and grip of the hand, wherein the flange-end of the sleeve, aligned to the central longitudinal axis of the sleeve, terminates in a non-oblique rounded cylinder which is generally perpendicular to the central axis of the sleeve.

Another aspect of the present disclosure is a sleeve adapted for receiving the solid or hollow gripping end of a sports stick, the sleeve comprising a central longitudinal axis, an imaginary coronal plane, an imaginary sagittal plane, a cavity for receiving the gripping end of the solid or hollow sports stick, and a grip adapted for being grasped by the hand of an athlete. The sagittal and coronal planes are mutually orthogonal and intersect along the central longitudinal axis. The grip comprises a grip end distal to the sleeve, a dorsal cantle region and a ventral cantle region. The dorsal and ventral cantle regions are between the sleeve end and the grip end and are on opposing sides of the imaginary coronal plane. The imaginary sagittal plane intersects and subdivides each of the dorsal and cantle regions, respectively, into two parts. The dorsal and ventral cantle regions each provide a curved support surface for the hand of the athlete when the athlete is gripping the sports stick and have a radius of curvature in the sagittal plane, the radius of curvature of the ventral cantle region being greater than the radius of curvature of the dorsal cantle region.

Another aspect of the present disclosure is a sleeve adapted for application to the solid or hollow end of a sports stick, the sleeve comprising a central longitudinal axis, an imaginary coronal plane, an imaginary sagittal plane, a neck for covering the gripping end surface of the solid or hollow end of the sports stick when the stick is inserted into a cavity within the neck, and a grip adapted for being grasped by the hand of an athlete. The sagittal and coronal planes are mutually orthogonal and intersect along the central longitudinal axis. The grip comprises a grip end distal to the neck end, a dorsal cantle region and a ventral cantle region. The dorsal and ventral cantle regions are between the neck end and the grip end, are on opposing sides of the imaginary coronal plane, and are bisected by the imaginary sagittal plane. The dorsal and ventral cantle regions each provide a curved support surface for the hand of the athlete when the athlete is gripping the sports stick and have a radius of curvature in the sagittal plane, the radius of curvature of the ventral cantle region being greater than the radius of curvature of the dorsal cantle region.

Another aspect of the present disclosure is a sleeve adapted to receive the end of a sports stick, the sleeve comprising a central longitudinal axis, a cavity for receiving the hollow end of the sports stick, and a grip adapted for being grasped by the hand of an athlete. The grip comprises a grip end distal to the tang, a dorsal cantle region and a ventral cantle region, the dorsal and ventral cantle regions being between the cavity and the grip end and on opposing sides of an imaginary coronal plane containing the central longitudinal axis and bisected by an imaginary sagittal plane that contains the central longitudinal axis and is orthogonal to the imaginary coronal plane. The dorsal and ventral cantle regions provide curved support surfaces for the hand of the athlete when the athlete is gripping the sports stick, wherein the dorsal cantle region and ventral cantle region are asymmetric relative to each other about the coronal plane. Stated differently, the dorsal and cantle regions are not mirror images of each other.

Another aspect of the present disclosure is a sleeve adapted for receiving the hollow end of a sports stick, the knob comprising a central longitudinal axis, a cavity for receiving the hollow end of the sports stick and a grip adapted for being grasped by the hand of an athlete. The grip comprises a grip end distal to the tang, a dorsal cantle region and a ventral cantle region, the dorsal and ventral cantle regions being between the cavity and the grip end and on opposing sides of an imaginary coronal plane containing the central longitudinal axis and bisected by an imaginary sagittal plane that contains the central longitudinal axis and is orthogonal to the imaginary coronal plane. The dorsal and ventral cantle regions provide curved support surfaces for the hand of the athlete when the athlete is gripping the sports stick, wherein the dorsal cantle region and ventral cantle region are asymmetric relative to each other and the volume of the dorsal cantle region exceeds the volume of the ventral cantle region.

Other objects and features will be in part apparent and in part pointed out hereinafter.

BRIEF DESCRIPTION OF THE DRAWINGS

Corresponding reference characters indicate corresponding parts throughout the drawings.

ABBREVIATIONS AND DEFINITIONS

Figure 1:
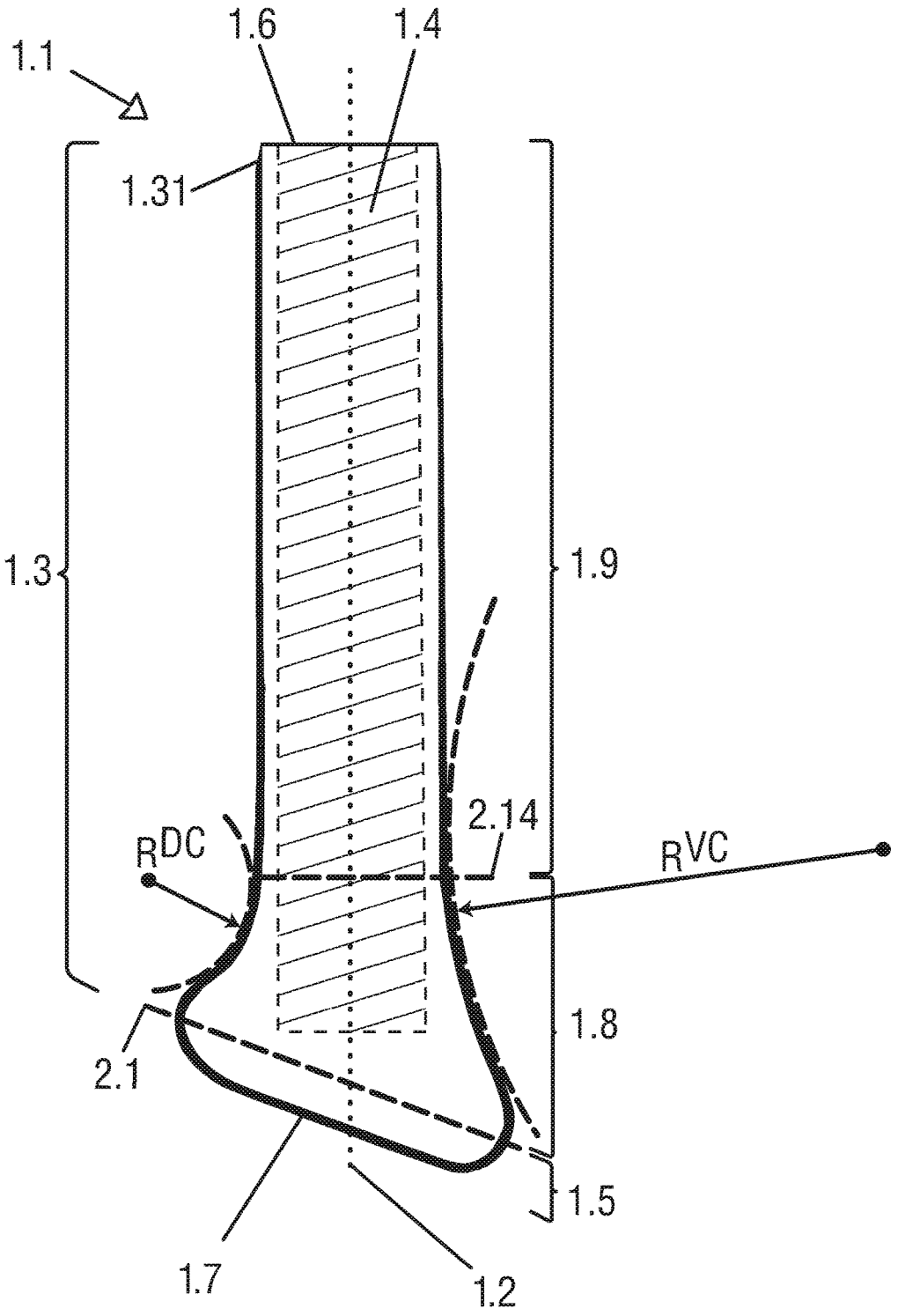
FIG. 1 is a profile view of a sleeve of the present disclosure for use in combination with a sports stick

The following definitions and methods are provided to better define the present disclosure and to guide those of ordinary skill in the art in the practice of the present disclosure. Unless otherwise noted, terms are to be understood according to conventional usage by those of ordinary skill in the relevant art.

The term "axially symmetric" as used herein refers to symmetry about an axis in a direction that is perpendicular to the axis.

The term "cantle" as used herein in connection with a surface refers to a surface that is curved upwardly similar to the raised, curved part at the back of a horse saddle. In the context of the present disclosure, the cantle is adapted to engage the hypothenar of the gripping hand. Like a cantle of a saddle, which cradles the gluteus maximus or bottom of a rider, the cantle-like structure of the sleeve described herein cradles the hypothenar of the hand in the same way giving support, stability and increased surface area contact to the hand throughout a swing.

The term "coronal plane" as used herein refers to a plane containing the central longitudinal axis dividing a sleeve of the present disclosure (or an element thereof) into ventral and dorsal (anterior and posterior, respectively) sections. The coronal plane is orthogonal to the sagittal plane, and the two planes intersect along the central longitudinal axis.

The term "sagittal plane" as used herein refers to a vertical, longitudinal plane containing the central longitudinal axis which passes from anterior to posterior along the central longitudinal axis, dividing a sleeve of the present disclosure (or an element thereof) into right and left halves. The sagittal plane is orthogonal to the coronal plane, and the two planes intersect along the central longitudinal axis.

The term "supplementary angles" as used herein refers to two angles having a sum of 180 degrees.

When introducing elements of the present disclosure or the embodiments(s) thereof, the articles "a", "an", "the" and "said" are intended to mean that there are one or more of the elements. The terms "comprising", "including" and "having" are intended to be inclusive and not exclusive (i.e., there may be other elements in addition to the recited elements). The use of "or" means "and/or" unless specifically stated otherwise, and the use of the singular includes the plural and plural encompasses singular, unless specifically stated otherwise.

EMBODIMENTS

In brief overview, the present disclosure features an ergonomic sleeve for use with a solid or hollow swinging implement used in a sport such as a stick or club used to play hockey, lacrosse, baseball (including softball), cricket, or golf. More specifically, the sleeve is adapted to be applied to the solid or hollow end of such a stick or club and aligns with the range of motion and grip of the hand to provide increased support, increased surface area contact, increased grip stability, increased swing precision, increased stick control, increased swing-power transfer from hands through the stick to the targeted object and a reduction of injury causing compression factors.

The sleeve may be formed from any of a variety of materials that provide the mechanical strength and tactile properties for the sport. Typically, therefore, the sleeve will comprise a ceramic, metal, polymer, composite, wood or a composite or laminate thereof. For example, in some embodiments the sleeve comprises a metal or an alloy thereof. Exemplary metals and metal alloys include such as aluminum, an aluminum alloys, or other metal such as nickel, nickel alloys such as nickel iron, and cobalt alloys such as cobalt phosphorous, or a similar metallic material. By way of further example, in some embodiments the sleeve comprises a polymer such as an epoxy resin, polyamine, polyamide, polycarbonate, polyester, polyether, polyimide, polyurethane, polyvinyl chloride, laser-fused plastic powders, or a copolymer or blend thereof. By way of further example, in some embodiments the sleeve comprises a composite such as a fiber-reinforced polymer wherein the polymer is one of the aforementioned polymers or a copolymer or blend thereof, and the reinforcing fiber comprises aluminum fibers, an aramid or other polymeric fibers, carbon fibers, ceramic fibers, carbon nanotubes, glass fibers or a combination thereof. By way of further example, in one embodiment the sleeve is a laminate of wood or a polymeric material and a fiber reinforced composite. Additionally, the sleeve may be solid, or wholly or partly hollow.

The sleeve is adapted to be applied to a solid or hollow handle end of a swinging implement adapted for sports. In some embodiments, the solid or hollow shaft to which the sleeve is applied may comprise a material other than wood. For example, the solid or hollow shaft may comprise a material selected from the group consisting of ceramics, metals, polymers, composites, and combinations thereof (in laminate or non-laminate form). For example, in some embodiments the solid or hollow shaft of the swinging implement comprises a metal or an alloy thereof. Exemplary metals and metal alloys include aluminum, aluminum alloys, nickel, nickel alloys such as nickel iron, and cobalt alloys such as cobalt phosphorous. By way of further example, in some embodiments the solid or hollow shaft comprises a polymer such as an epoxy resin, polyamine, polyamide, polycarbonate, polyester, polyether, polyimide, polyurethane, polyvinyl chloride, or a copolymer or blend thereof. By way of further example, in some embodiments the solid or hollow shaft comprises a composite such as a fiber-reinforced polymer wherein the polymer is one of the aforementioned polymers and the reinforcing fiber comprises aluminum fibers, an aramid or other polymeric fibers, carbon fibers, ceramic fibers, carbon nanotubes, glass fibers or a combination thereof. By way of further example, in one embodiment the solid or hollow shaft comprises a laminate comprising an outer layer of resin-impregnated wood veneer formed integrally with an inner sheath of a fiber-reinforced fabric and resin composite. By way of further example, in one embodiment the solid or hollow shaft the two outer layers are formed over a core which may be formed of foamed plastic core. In an alternative embodiment, the foam core extends through the handle area and the blade is formed of synthetic fibers overlaid and bonded to an outer wood veneer sheath by resin which impregnates both layers.

Referring now to FIG. 1, a sleeve in accordance with one embodiment of the present disclosure is generally indicated by the reference numeral 1.1. Sleeve 1.1 comprises a grip 1.3 and butt end 1.5 disposed along central longitudinal axis 1.2. Grip 1.3 comprises the neck 1.9 and the Flange 1.8

Neck 1.9 extends from imaginary plane 2.14 longitudinally up neck end 1.6, and is adapted for being applied to the solid or hollow end of a sports stick (not shown) by insertion of the solid or hollow stick into cavity 1.4 within the neck, resulting in the greater sleeve enclosing a portion of the gripping handle of the sports stick. In some embodiments, the inner diameter and cross-sectional shape of the cavity 1.4 is adapted to conform to and closely fit over the outer longitudinal cross-section diameter of the solid or hollow stick. For example, the cavity 1.4 may have a polygonal (e.g., triangular, rectangular, pentagonal, hexagonal, etc.) oval, round or other regular or irregular cross-sectional shape that is adapted to conform to and closely fit the outer cross-sectional shape of the solid or hollow swinging implement. Additionally, the cavity 1.4 will have a length (measured along central longitudinal axis 1.2) to provide adequate insertion depth of the solid or hollow handle of the swinging implement to provide a secure and solid connection between the sleeve and the stick. For example, in one embodiment cavity 1.4 has a length (measured along central axis 1.2) of about 2 inches to about 3 inches. By way of further example, in one embodiment cavity 1.4 has a length of about 3 inches to about 5 inches. By way of further example, in one embodiment cavity 1.4 has a length of about 5 inches to about 12 inches. Additionally, in one embodiment, upon insertion of the solid or hollow end of the sports stick into cavity 1.4, the central longitudinal axis 1.2 is aligned with the central longitudinal axis of the sports stick to provide a shared common longitudinal axis. There are many options for securing the solid or hollow stick to the interior cavity 1.4 which include, but are not limited to screws, nails, staples, glue, adhesive, heat-activated glue, epoxies and others.

Figure 3B:
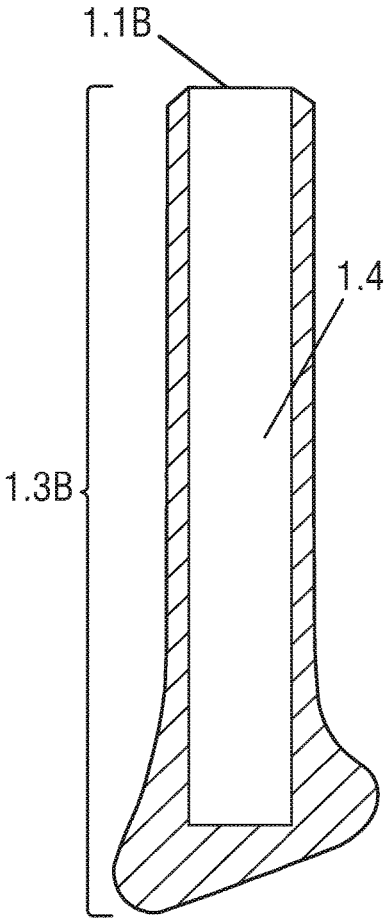
FIG. 3B is a cross-section of the sleeve of FIG. 3A, taken along sagittal plane SP.
Figure 5:
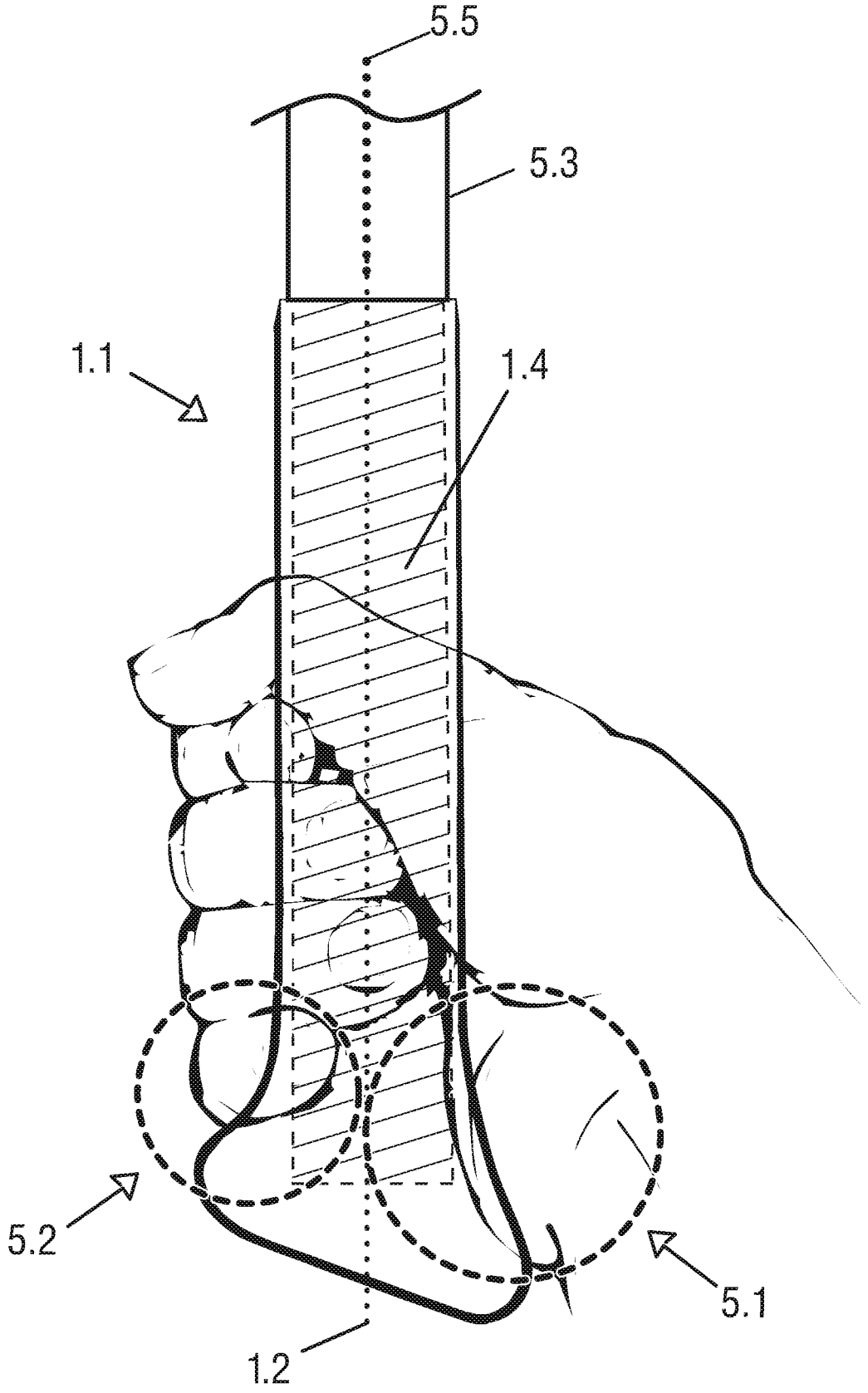
FIG. 5 is a profile view of the embodiment of FIG. 1, with a fragmentary of a sport stick inserted into the sleeve with a gripping hand with the insertion portion of the stick being shown in phantom.

Sleeve 1.1 is adapted to provide a structure and surface that enables an athlete to firmly grasp sleeve 1.1 while supporting an athlete's gripping hand (FIG. 5). Grip 1.3 extends from neck end 1.6 to imaginary plane 2.1 and includes neck region 1.9 and flange region 1.8. In one embodiment and referring now to FIGS. 3A, 3B and 3C, sleeve 1.1 is divided into two parts by imaginary sagittal plane SP. In one such embodiment, sleeve 1.1 is bisected by imaginary sagittal plane SP. Stated differently, in this embodiment cross-section 1.3B (FIG. 3B) and cross-section 1.3C (FIG. 3C), respectively, are mirror images of each other.

Figure 2:
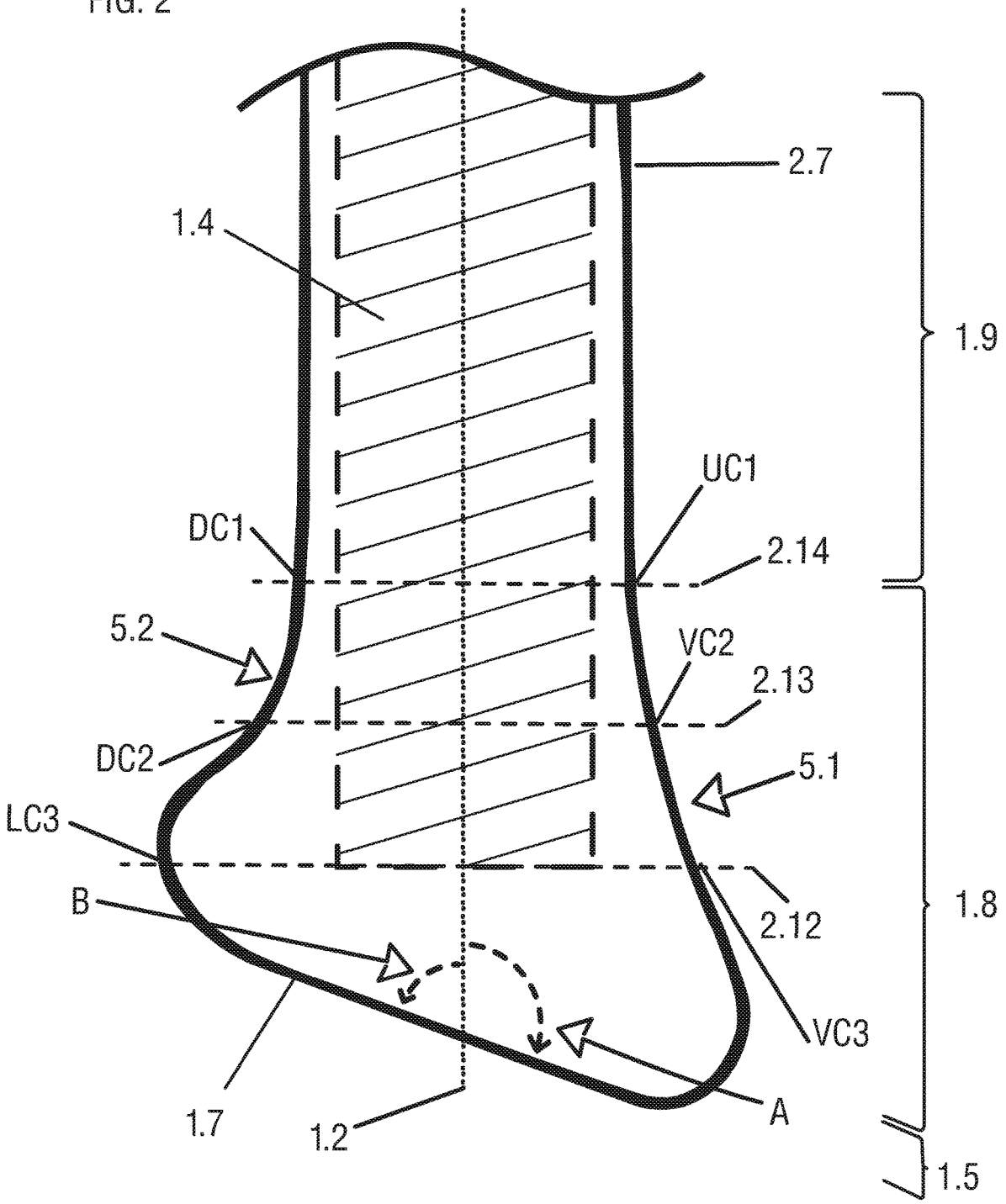
FIG. 2 is a detail view of the sleeve of FIG. 1 with a portion of neck 1.9 removed.
Figure 2A:
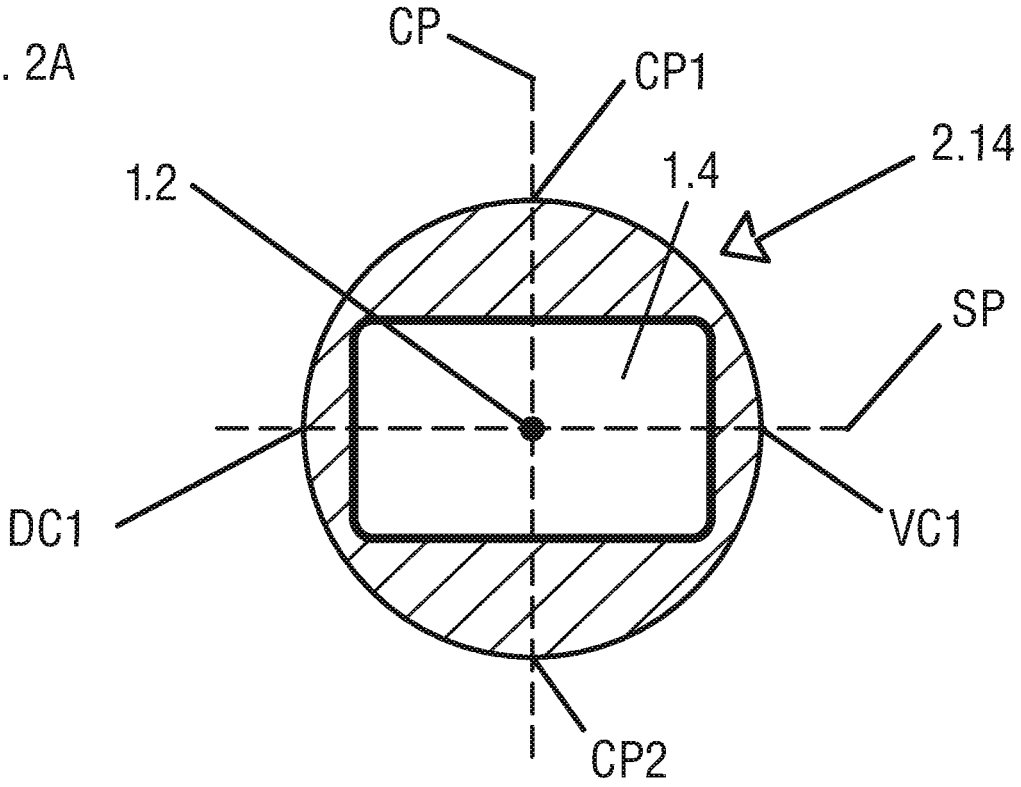
FIG. 2A is a cross-section of the sleeve of FIG. 1 taken along imaginary plane 2.14 and perpendicular to the central longitudinal axis.

Referring now to FIG. 2, neck 1.9 is adapted to provide a gripping surface for the palm, thumb, index finger, middle finger and ring finger of the gripping hand of an athlete (see FIG. 5) and a smooth transition from the handle of the sports stick where the neck end 1.6 engages the solid or hollow handle end of the sports stick to flange 1.8 when the solid or hollow handle end of the sports stick is inserted into cavity 1.4. Moving in the direction from neck end 1.6 to imaginary plane 2.14, the neck transitions from a cross section that matches the cross-section of the outer longitudinal surfaces of the solid or hollow stick (when viewed in cross-section perpendicular to central longitudinal axis 1.2) to a smooth, cross-section (e.g., rounded cross-section) in the region of imaginary plane 2.14. Stated differently, and referring now to FIG. 2A in one embodiment imaginary points CP1 and CP2 and imaginary points VC1 and DC1 are approximately equidistant from central longitudinal axis 1.2 at imaginary plane 2.14.

The neck can be of varying lengths, cross sectional shapes and perimeters without departing from the principles of the disclosure. For example, in one embodiment neck 1.9 has a length (measured along central longitudinal axis 1.2) of at least about 0.25 inches. In general, however, neck will have a length of less than about 18 inches. In some exemplary embodiments, the neck will have a length of about 0.25 to about 4 inches. In other embodiments, the neck will have a length of about 1 to 8 inches. In other embodiments, the neck will have a length of about 1 to about 2 inches. In other embodiments, the neck will have a length of about 0.5 to about 1.5 inches.

Figure 2B:
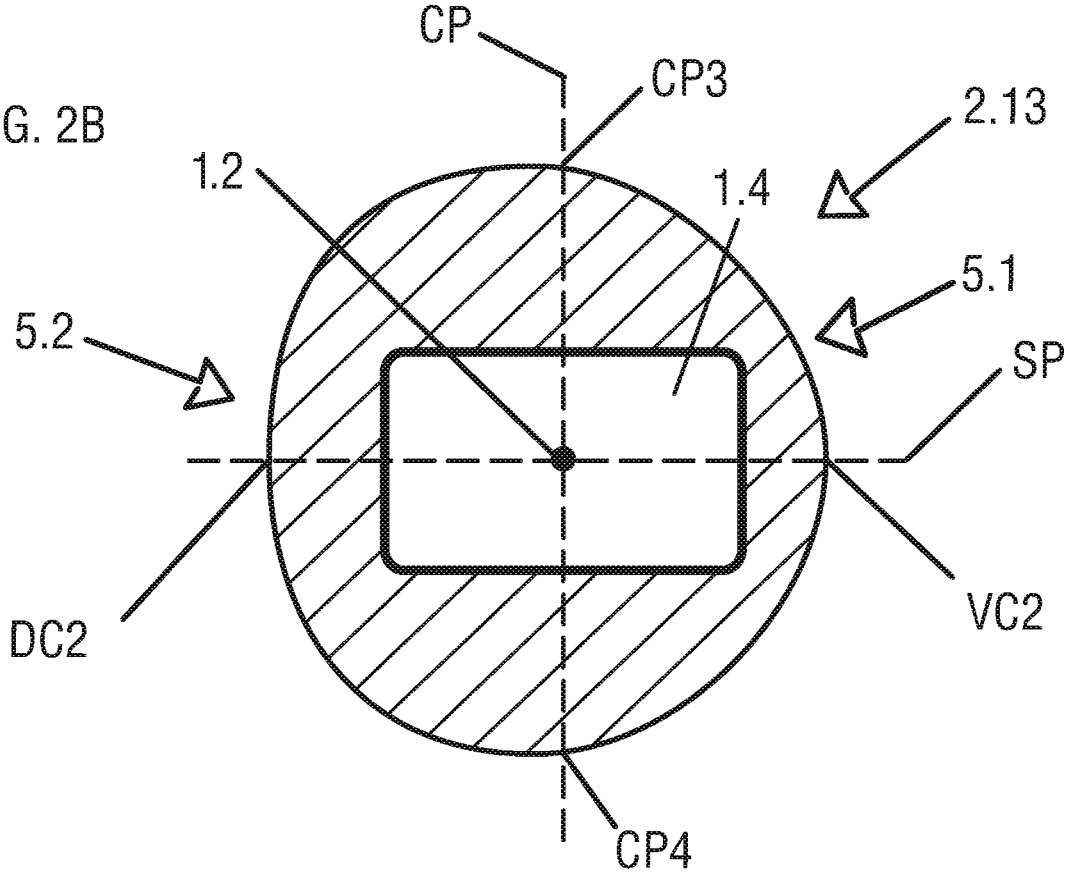
FIG. 2B is a cross-section of the sleeve of FIG. 1 taken along imaginary plane 2.13 and perpendicular to the central longitudinal axis.
Figure 2C:
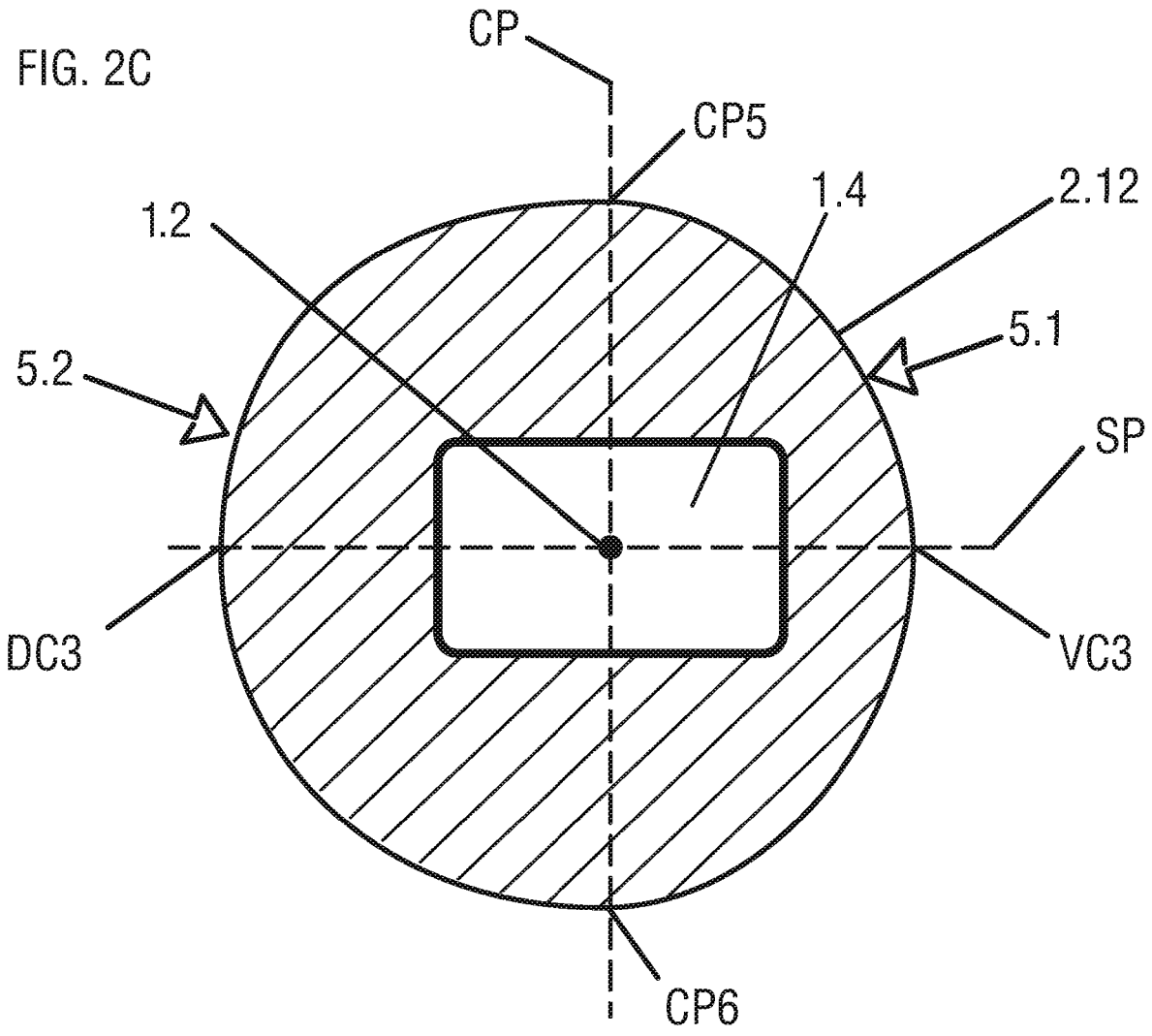
FIG. 2C is a cross-section of the sleeve of FIG. 1 taken along imaginary plane 2.12 and perpendicular to the central longitudinal axis.

Referring again to FIG. 2, flange 1.8 extends between neck 1.9 and grip end 1.5 and is adapted to provide a gripping and supporting surface for the little finger (sometimes referred to as the "small finger" or the "pinky") and the hypothenar of the athlete's gripping hand (see FIG. 5). Flange 1.8 smoothly increases in circumference from imaginary transverse plane 2.14 to grip end 1.5. To provide the desired support, flange 1.8 comprises ventral cantle region 5.1 and dorsal cantle region 5.2 that support the small finger and hypothenar, respectively. In general, ventral cantle region 5.1 and dorsal cantle region 5.2 are separated by imaginary coronal plane CP (coincident with central longitudinal axis 1.2 in FIGS. 2 and 5; see FIGS. 6 and 7). Additionally, and moving along central longitudinal axis 1.2 in a direction toward grip end 1.5, ventral cantle region 5.1 and dorsal cantle region 5.2 gradually curve away from central longitudinal axis with dorsal cantle region 5.2 having a radius of curvature $R^{DC}$ that is less than the radius of curvature $R^{VC}$ of ventral cantle region 5.1 (see FIG. 1). For example, in one embodiment, the ratio of $R^{DC}$ to $R^{VC}$ will be at least 2:1. By way of further example, in one embodiment the ratio of $R^{DC}$ to $R^{VC}$ will be at least 3:1. By way of further example, in one embodiment the ratio of $R^{DC}$ to $R^{VC}$ will be at least 4:1. By way of further example, in one embodiment the ratio of $R^{DC}$ to $R^{VC}$ will be at least 5:1. In general, however, the ratio of $R^{DC}$ to $R^{VC}$ will be less than about 20:1. Thus, for example, in some embodiments the ratio of $R^{DC}$ to $R^{VC}$ will be in the range of about 3:1 to about 20:1. By way of further in one embodiment the ratio of $R^{DC}$ to $R^{VC}$ will be in the range of about 4:1 to about 17.5:1. By way of further in one embodiment the ratio of $R^{DC}$ to $R^{VC}$ will be in the range of about 5:1 to about 15:1. By way of further in one embodiment the ratio of $R^{DC}$ to $R^{VC}$ will be in the range of about 5:1 to about 10:1. As a result of the difference in the radii of curvature (i.e., $R^{VC}>R^{DC}$) the volume of dorsal cantle region exceeds the volume of ventral cantle region. This difference in volume may be seen, for example, in FIGS. 2B and 2C, which illustrate cross-sections of flange 1.8 taken along imaginary planes 2.13 and 2.12, respectively. As depicted in FIG. 2B, the distance from central longitudinal axis to imaginary point DC2 at the surface of the dorsal cantle region exceeds the distance from central longitudinal axis to imaginary point VC2 at the surface of the ventral cantle region and the semicircle on the dorsal side of coronal plane CP (i.e., the semicircle containing imaginary points CP3, CP4 and DC2 and coronal plane CP) has a greater surface area than the semicircle on the ventral side of coronal plane CP (i.e., the semicircle containing imaginary points CP3, CP4 and VC2 and coronal plane CP). Similarly, and as depicted in FIG. 2C, the distance from central longitudinal axis to imaginary point DC3 at the surface of the dorsal cantle region exceeds the distance from central longitudinal axis to imaginary point VC3 at the surface of the ventral cantle region and the semicircle on the dorsal side of coronal plane CP (i.e., the semicircle containing imaginary points CP5, CP6 and DC3 and coronal plane CP) has a greater surface area than the semicircle on the ventral side of coronal plane CP (i.e., the semicircle containing imaginary points CP5, CP6 and VC3 and coronal plane CP). Additionally, ventral cantle region 5.1 and dorsal cantle region 5.2 each increase in size moving along central longitudinal axis in the direction of grip end 1.5. Stated differently, the cross-sectional area of ventral cantle region 5.1 and dorsal cantle region 5.2 taken along imaginary plane 2.12 exceeds the cross-sectional area of ventral cantle region 5.1 and dorsal cantle region 5.2 taken along imaginary plane 2.13. As a result, ventral cantle region 5.1 provides a more gradual transition between the neck 1.9 and grip end 1.5, thereby providing a more comfortable resting place for the hypothenar or "heal" of the hand, the palmar arches, and the fifth digit (i.e., pinky finger).

Grip end 1.5 is configured to cooperate with the user's hand so as to help prevent the user's hand from slipping from the grip 1.3 and terminates in generally planar bottom surface 1.7 disposed at an oblique angle relative to central longitudinal axis 1.2. In general, the grip end will have a circumference that exceeds the circumference of the neck 1.9 proximate step 1.31. For example, in one embodiment grip end 1.5 will have a circumference that is at least 110% of the circumference of the neck 1.9 proximate step 1.31. By way of further example, in one embodiment grip end 1.5 will have a circumference that is at least 150% of the circumference of the neck 1.9 proximate step 1.31. By way of further example, in one embodiment grip end 1.5 will have a circumference that is at least 200% of the circumference of the neck 1.9 proximate step 1.31. Typically, however, grip end 1.5 will have a circumference that is less than 300% of the circumference of the neck 1.9 proximate step 1.31. Thus, in some embodiments grip end 1.5 will have a circumference that is in the range of about 110 to 300% of the circumference of the neck 1.9 proximate step 1.31. For example, in some embodiments grip end 1.5 will have a circumference that is in the range of 110-150%, 150 to 200% or even 200-300% of the circumference of the neck 1.9 proximate step 1.31.

In one embodiment, surface 1.7 of grip end is at an oblique angle relative to central longitudinal axis. For example, and referring now to FIG. 2 in one embodiment angle A is between 90 and 170 degrees and angle B is between 10 and 90 degrees, wherein angles A and B are supplementary angles. By way of further example, in one embodiment A is between 90 and 120 and degrees and angle B is between 90 and 60 degrees, wherein angles A and B are supplementary angles. By way of further example in one embodiment A is between 120 and 170 degrees and angle B is between 60 and 10 degrees, wherein angles A and B are supplementary angles.

In one embodiment, cavity 1.4 will have a length, as measured along central longitudinal axis 1.2, that is about 5 to about 95% of the distance between grip end 1.5 and neck end 1.6, as measured along central longitudinal axis 1.2, that is about 95 to about 5% of the distance between grip end 1.5 and neck end 1.6. For example, in one such embodiment, grip 1.3 will have a length, as measured along central longitudinal axis 1.2, that is about 15 to about 85% of the distance between grip end 1.5 and cavity end 1.6 as measured along central longitudinal axis 1.2, that is about 85 to about 15% of the distance between grip end 1.5 and neck end 1.6. By way of further example, in one embodiment grip 1.3 will have a length, as measured along central longitudinal axis 1.2, that is about 25 to about 75% of the distance between grip end 1.5 and neck end 1.6 as measured along central longitudinal axis 1.2, that is about 75 to about 25% of the distance between grip end 1.5 and neck end 1.6. By way of further example, in one embodiment grip 1.3 will have a length, as measured along central longitudinal axis 1.2, that is about 35 to about 65% of the distance between grip end 1.5 and neck end 1.6 as measured along central longitudinal axis 1.2, that is about 65 to about 35% of the distance between grip end 1.5 and neck end 1.6. By way of further example, in one embodiment grip 1.3 will have a length, as measured along central longitudinal axis 1.2, that is about 40 to about 60% of the distance between grip end 1.5 and neck end 1.6 as measured along central longitudinal axis 1.2, that is about 60 to about 40% of the distance between grip end 1.5 and neck end 1.6.

Figure 3A:
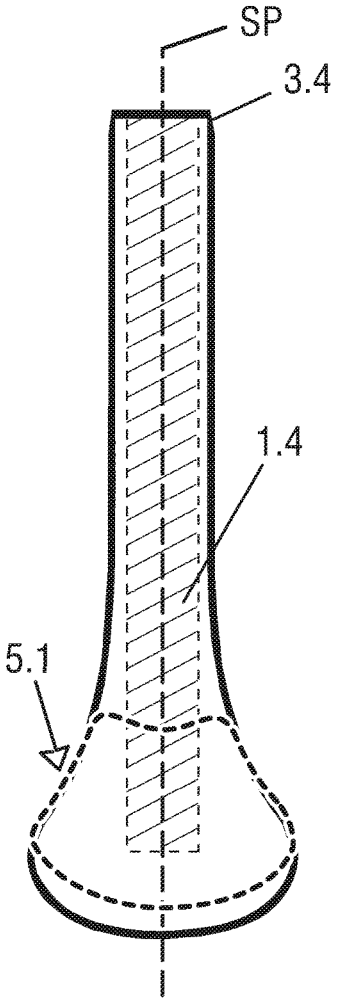
FIG. 3A is a front view of the sleeve of FIG. 1.
Figure 3C:
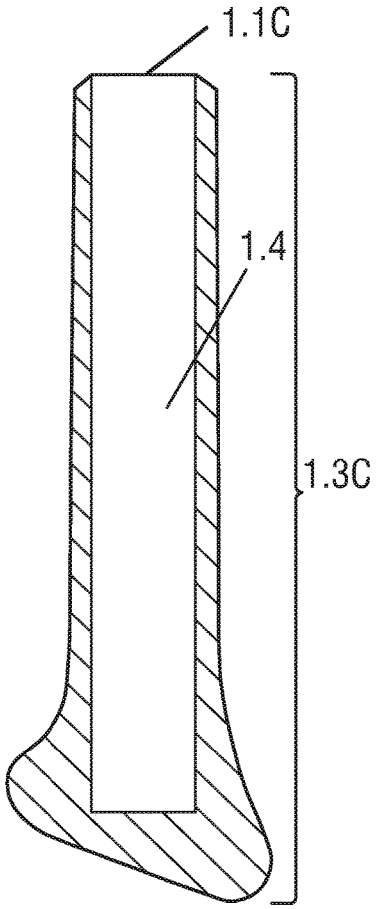
FIG. 3C is a cross-section of the sleeve of FIG. 3A, taken along sagittal plane SP and is the complementary cross-section to the cross-section of FIG. 3B.
Figure 4:
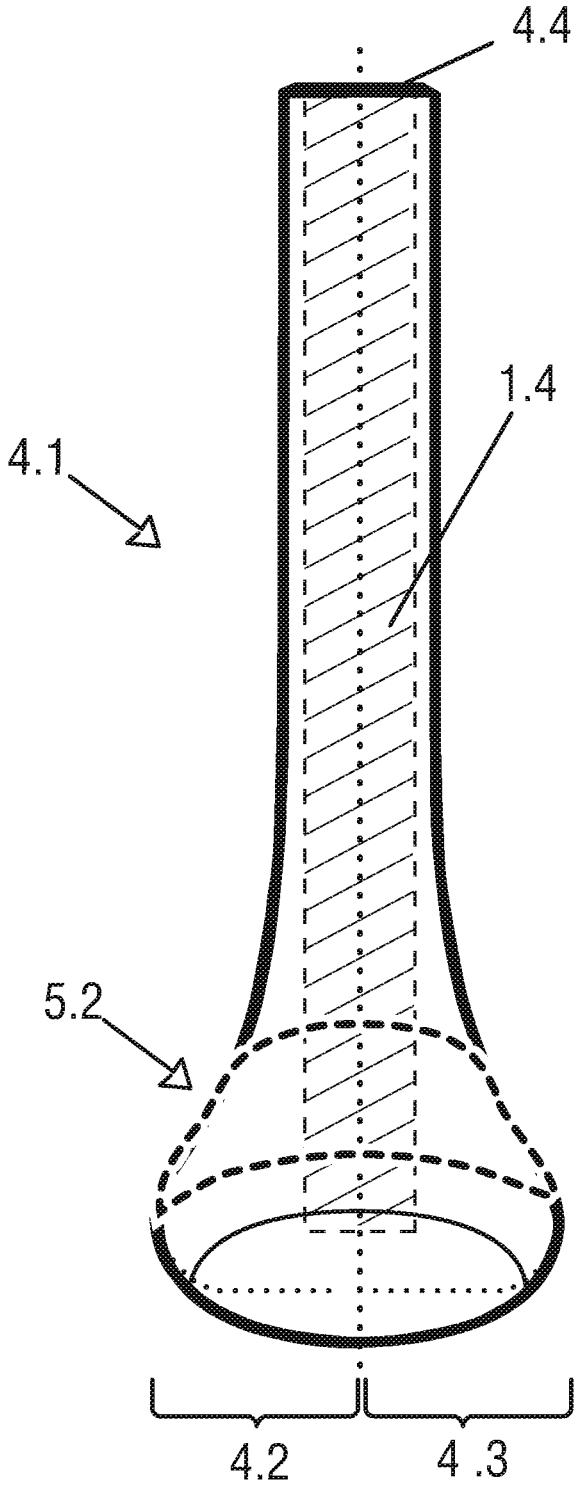
FIG. 4 is a back view of the embodiment of FIG. 1.

FIG. 3A shows the sleeve in front view with the ventral cantle region shown comprising generally half the circumference of the sleeve and smoothly transitioning to the dorsal cantle gripping surface on the opposing side of the sleeve as shown in FIG. 4. The two longitudinal oppositional halves of the sleeve, shown in FIGS. 3B and 3C, with the shared sagittal plane SP are mirrored shapes, providing the same structural support to hypothenar of a gripping hand, regardless of which hand is gripping the sleeve—left hand or right hand.

FIG. 4 is a rear view of the sleeve 1.1 and depicts dorsal cantle region 5.2 (shown in dashed lines. As previously described, dorsal cantle region smoothly transitions to the ventral cantle region on the opposing side of the sleeve (see FIG. 3). The two longitudinal halves of the sleeve, left longitudinal half 4.2 and right longitudinal half 4.3 are separated by the imaginary plane (coincident with central longitudinal axis 1.2) are mirrored shapes, providing the same structural to the little finger of a gripping hand, regardless of which hand is gripping the sleeve left hand or right hand.

FIG. 5 shows the embodiment of FIG. 1 (with stick 5.3 fully inserted (shown in phantom) into the cavity 1.4 of the sleeve having a sports stick longitudinal axis 5.5 that is coincident with central longitudinal axis 1.2) with a gripping right hand wherein the hypothenar of the gripping hand is cradled by the ventral cantle region, generally indicated 5.1, and wherein the small finger is gripping the dorsal cantle structure generally indicated 5.2. Given the longitudinal symmetry of the sleeve (about the imaginary sagittal plane) as described above, the gripping hand, left or right, gripping the same sleeve will properly align with the structures of the sleeve with either hand to provide proper support and grip. Additionally, this arrangement allows the small finger of the gripping hand to firmly grasp, generally around the central axis of the sleeve, in opposition to the hypothenar, thereby enabling a strong and stable grip on the sleeve and thus to the stick to which it is inserted into cavity 1.4 of the sleeve.

Figure 6:
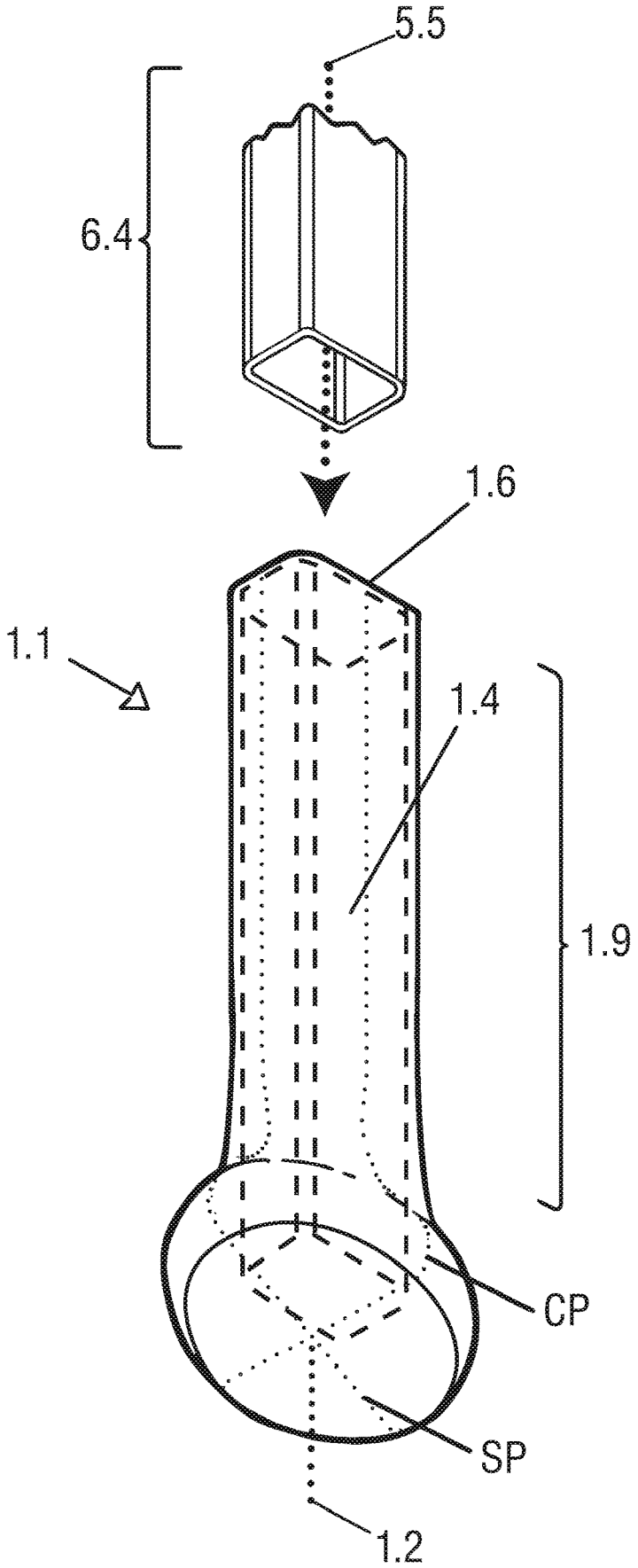
FIG. 6 is a ¾ below perspective view of the embodiment of FIG. 1, with a fragmentary of a hollow rectangular stick.

FIG. 6 shows a ¾ rear view of the embodiment of FIG. 1, with a generally rectangular cavity, 1.4, for close longitudinal insertion by a solid or hollow, generally rectangular stick, as indicated 6.4. Neck 1.9 provides a transitions from the generally smoothly curved flange (as previously described in connection with FIGS. 1 and 2) to a generally smaller diameter, cross sectional shape which disposes at neck end 1.6, whose outer most circumference dimensions, align with the outer most cross-sectional circumference dimensions of the solid or hollow end of the stick to which the sleeve is applied. FIG. 6 shows the neck structure, 1.9, shaped and aligned for close insertion by the solid or hollow, longitudinal end of a hockey stick, 6.4 having longitudinal axis 5.5. Upon insertion of stick 6.4 into the cavity sleeve end 1.6 of the sleeve, central longitudinal axis 1.2 and stick longitudinal axis 5.5 are coincident.

Figure 7:
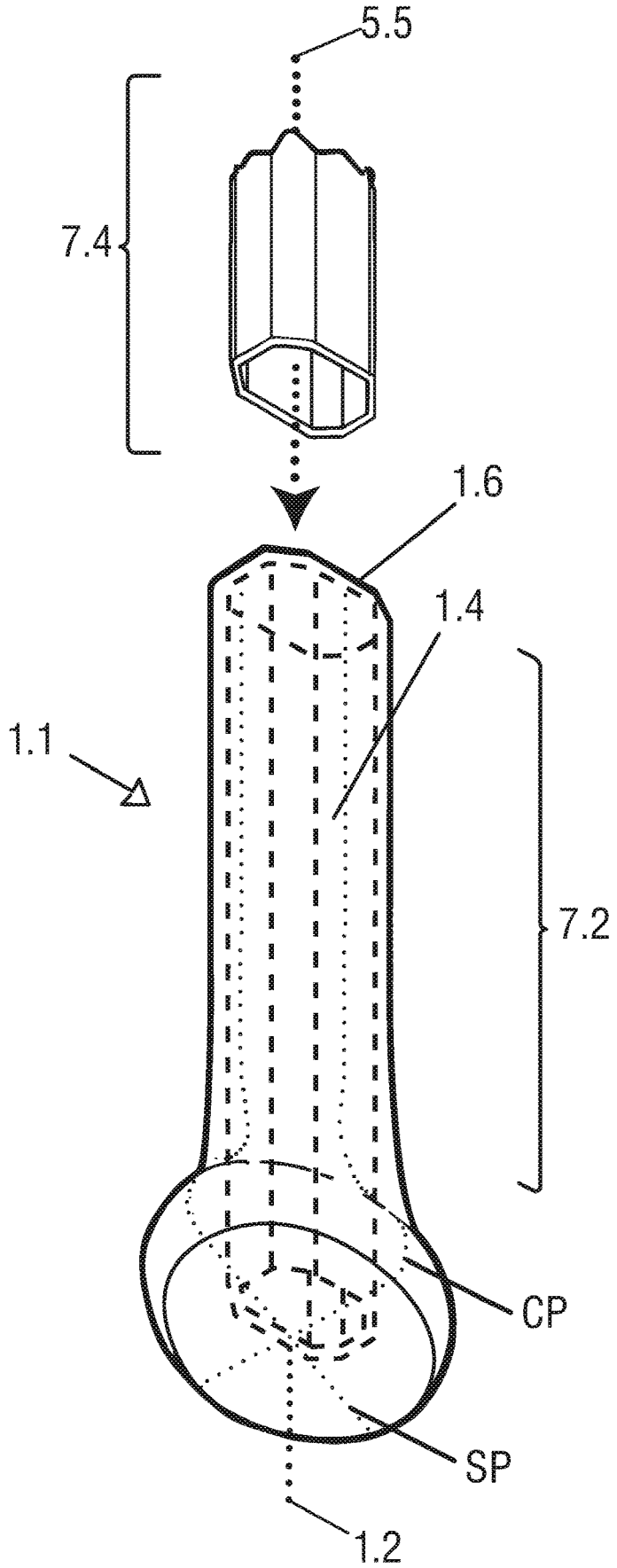
FIG. 7 is a ¾ below perspective of the embodiment of FIG. 1, adapted with an octagonal sleeve with a fragmentary of a hollow octagonal stick.

FIG. 7 shows a ¾ rear view of an alternative embodiment of FIG. 1, with a generally octagonal neck, 7.2, for close longitudinal insertion by a solid or hollow, generally octagonal stick 7.4, as the greater number of lacrosse sticks are comprised. In this embodiment, sleeve 7.2 has an octagonal cross-section exterior and cavity to match the outer cross-section of stick 7.4. The neck 7.2, transitions the generally round cross section of the flange to a generally octagonal cross section as demonstrated in the description of FIG. 2.

FIG. 6 and FIG. 7 demonstrate just two of a multitude of possible combinations of sleeve shape and solid or hollow stick shapes which can allow the present disclosure to be affixed to any number of solid or hollow sticks, handles, shafts and the like.

Figure 8:
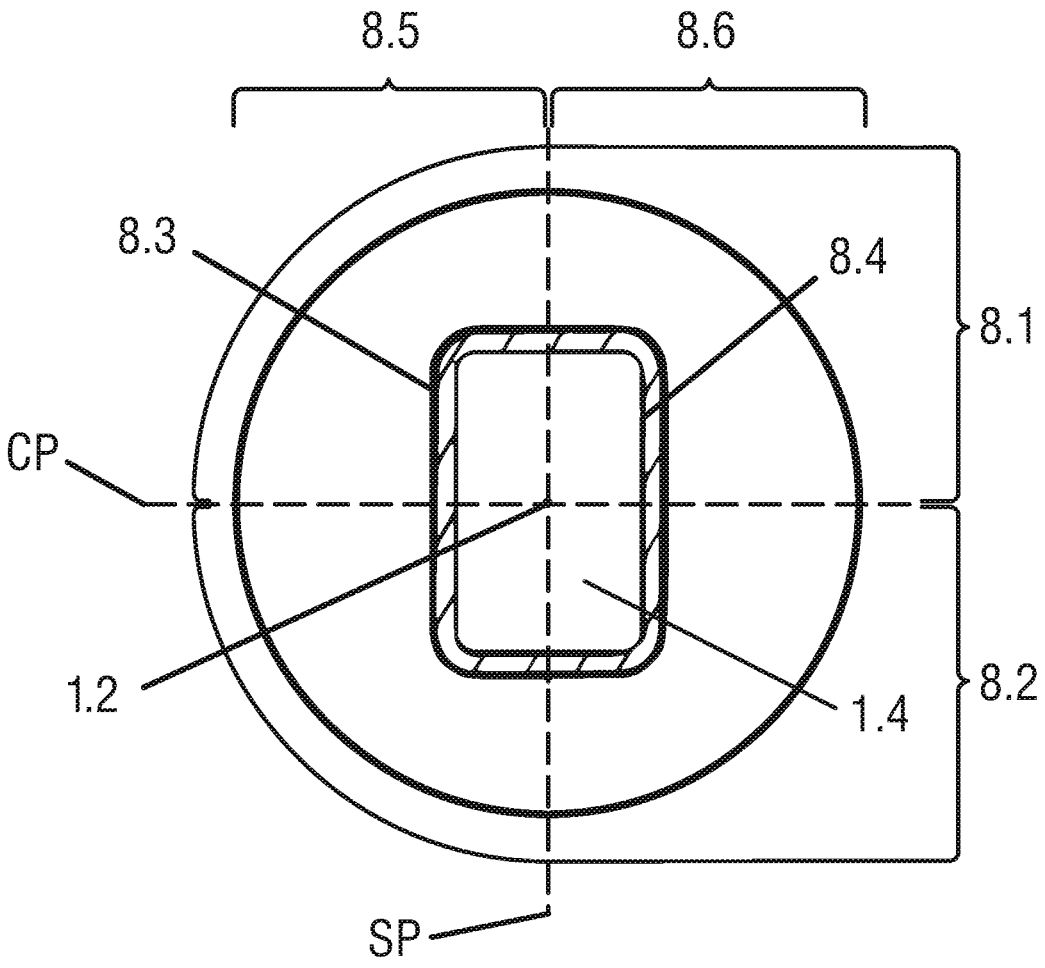
FIG. 8 is a top view of the sleeve for application with a solid or hollow rectangular stick.

FIG. 8 shows a top view of the embodiment shown in FIG. 6, from the generally rectangular neck-end 1.6 of the sleeve. The top view of the ventral cantle region is generally indicated 8.1 and the top view of the dorsal cantle gripping structure is generally indicated 8.2. The mirrored longitudinal halves of the sleeve, as previously described, are generally indicated 8.5 and 8.6. The neck and cavity as shown are configured for alignment with a generally rectangular solid or hollow stick similar to those comprising hockey sticks.

Figure 9:
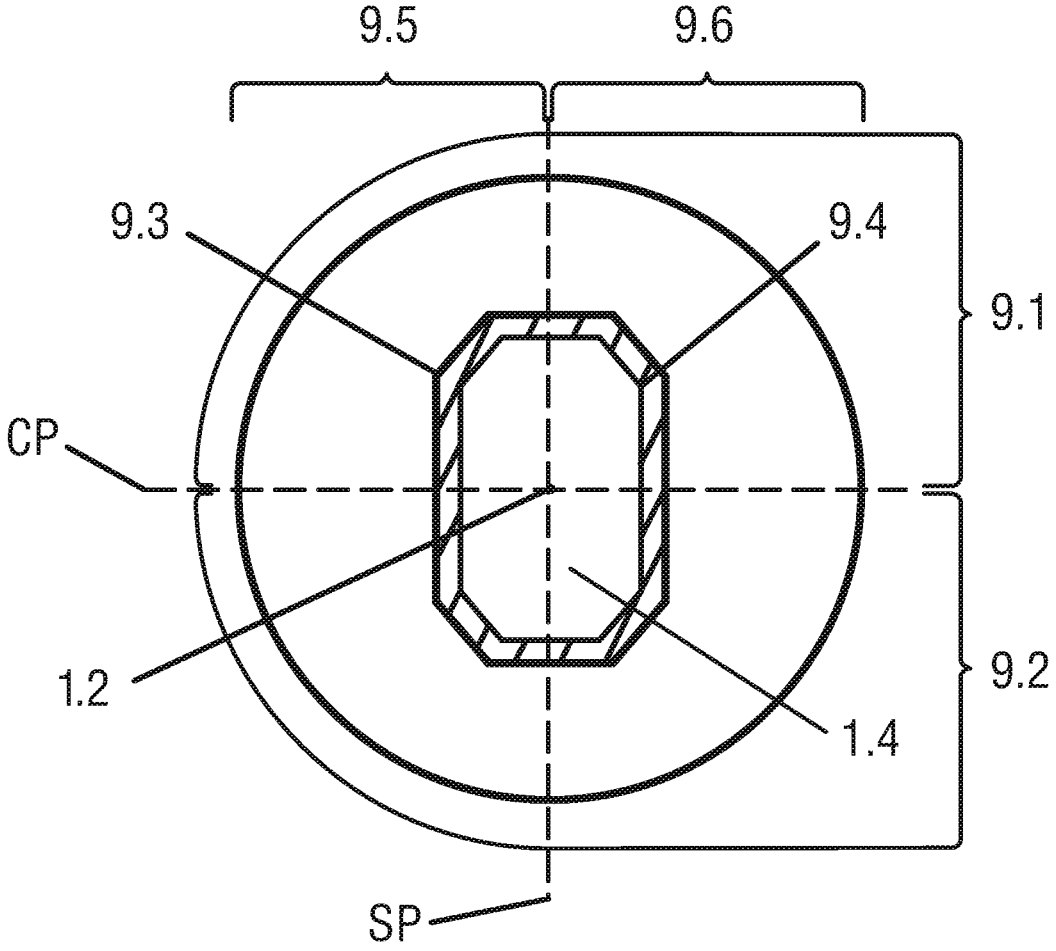
FIG. 9 is a top view of the sleeve for application with a solid or hollow octagonal stick.

FIG. 9 shows a top view of the embodiment shown in FIG. 7 of a generally octagonal neck end, from the neck-end of the sleeve with the central longitudinal axis of the sleeve indicated as 1.2. The top view of the ventral cantle region is generally indicated 9.1, and the top view of the dorsal cantle gripping structure is generally indicated 9.2. The mirrored longitudinal halves of the sleeve, as previously described, are generally indicated 9.5 and 9.6. The neck and cavity as shown are configured for alignment with a generally octagonal hollow stick similar to those comprising lacrosse sticks.

As demonstrated in FIG. 8 and FIG. 9, the dorsal and ventral cantle support and gripping structures remain generally unchanged while the shape of the cavity and the neck of the sleeve may comprise different dimensions and shapes without departing from the scope of the disclosure.

Figure 10:
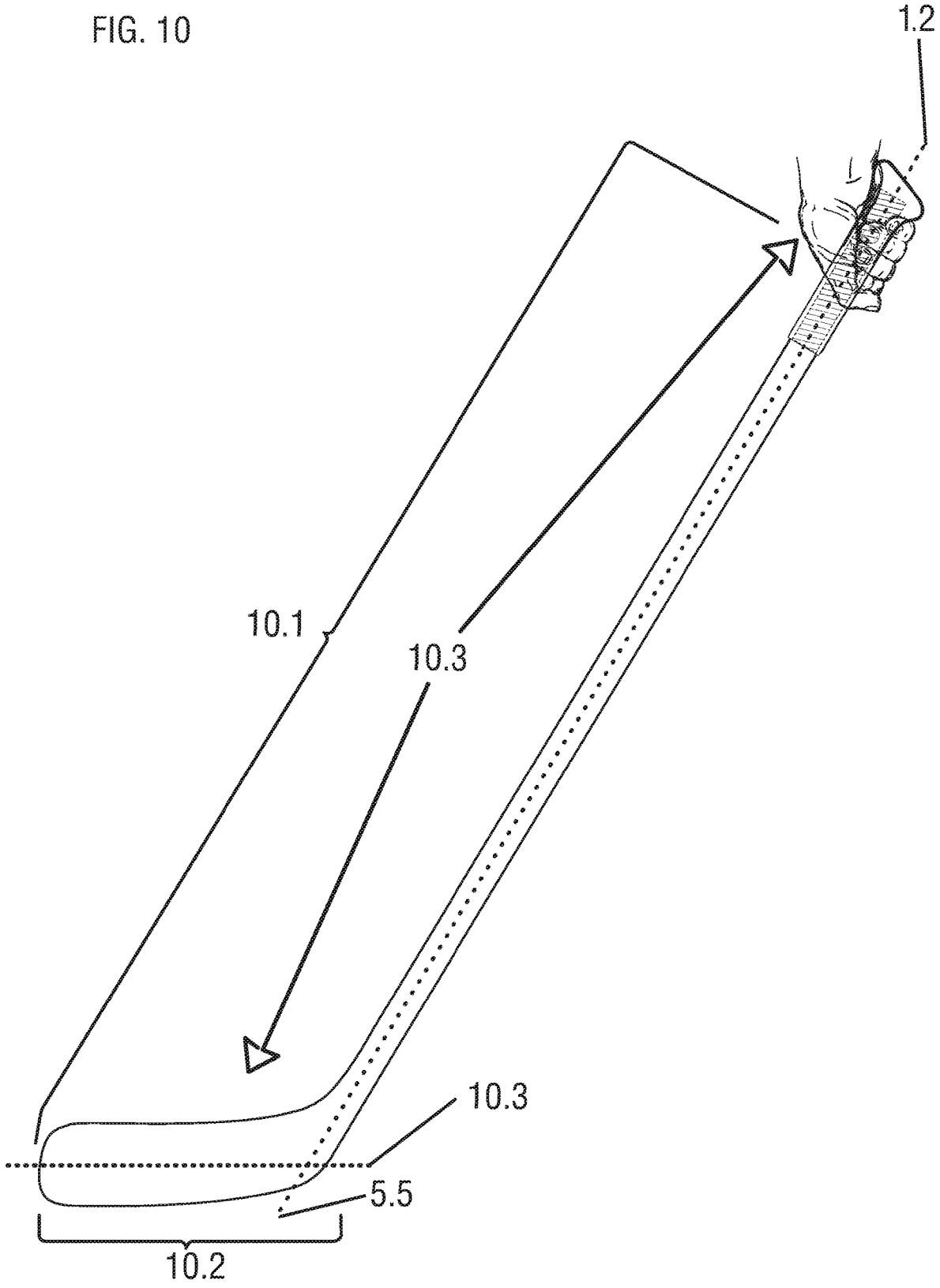
FIG. 10 is a profile view of a complete hockey stick with the embodiment of FIG. 1 applied to the handle end with a gripping hand.

FIG. 10 shows the sleeve and hand of FIG. 5, with the handle end of the hockey stick fully inserted into the cavity, as indicated 10.1. The sleeve is affixed to the stick, with the ventral cantle surface facing upward with the sagittal plane aligning on the same plane as the blade of the stick, in an orientation which specifically brings the proper gripping relationship of the hand and the stick into proper alignment wherein the blade, as shown 10.2, aligns on the same side of the coronal plane 10.3 of the stick as the ventral cantle-like supporting surface of the sleeve. In this embodiment, central longitudinal axis 1.2 is coincident with longitudinal axis 5.5 of the hockey stick.

Figure 11:
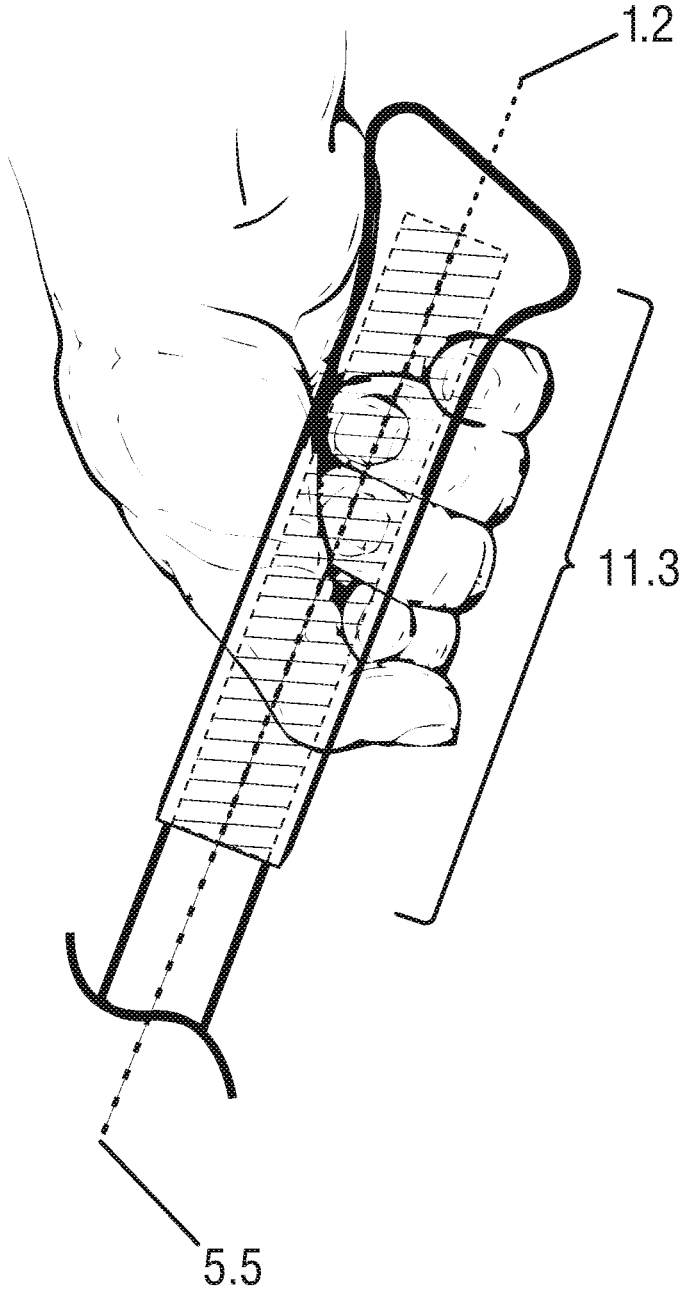
FIG. 11 is an enlarged, fragmentary, profile view of FIG. 10.

FIG. 11 shows in greater detail, the sleeve, gripping hand and fragmentary of the hockey stick from FIG. 10, wherein the stick 10.1 is fully inserted into the sleeve cavity 1.4. The central longitudinal axis of the sleeve, 1.2 is shown in parallel overlay, 11.3, with the central longitudinal axis of the hockey stick 5.5. Further, the external longitudinal surfaces of the hockey stick directly align with the external longitudinal surfaces of the neck of the sleeve providing a contiguous surface from stick to sleeve.

Figure 12:
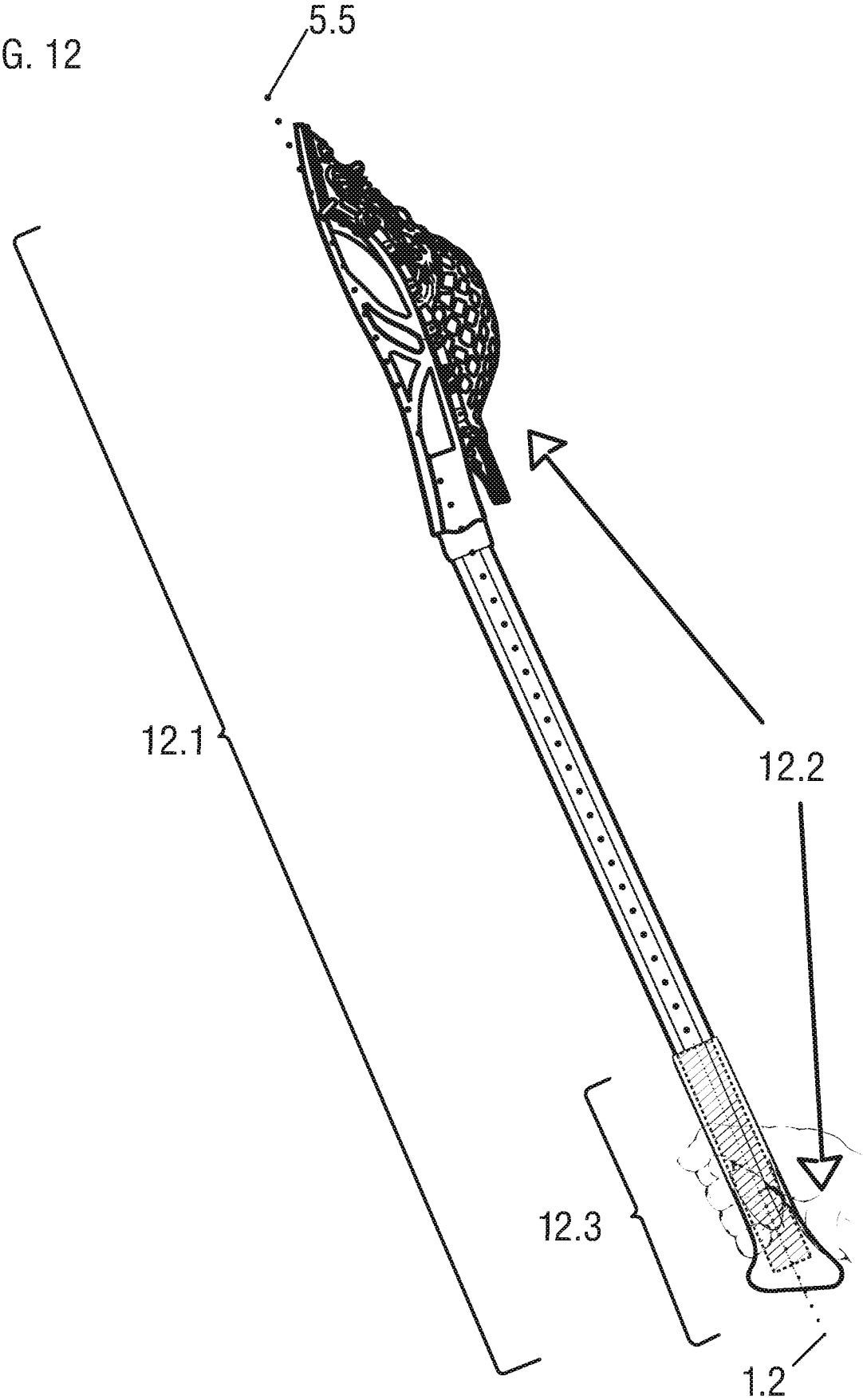
FIG. 12 is a profile view of a lacrosse stick with the embodiment of FIG. 1 applied to the handle end with a gripping hand.

FIG. 12 shows the sleeve of FIG. 7, with gripping hand, fully affixed to a lacrosse stick, as indicated 12.1. The sleeve is affixed to the stick in an orientation which specifically brings the gripping relationship of the hand and the stick into proper alignment wherein the net-side of the head, as shown 12.2, aligns on the same side of the stick as the ventral cantle-like supporting surface of the sleeve 12.3. This is generally the proper relationship for the base-gripping hand to engage a lacrosse stick.

Figure 13:
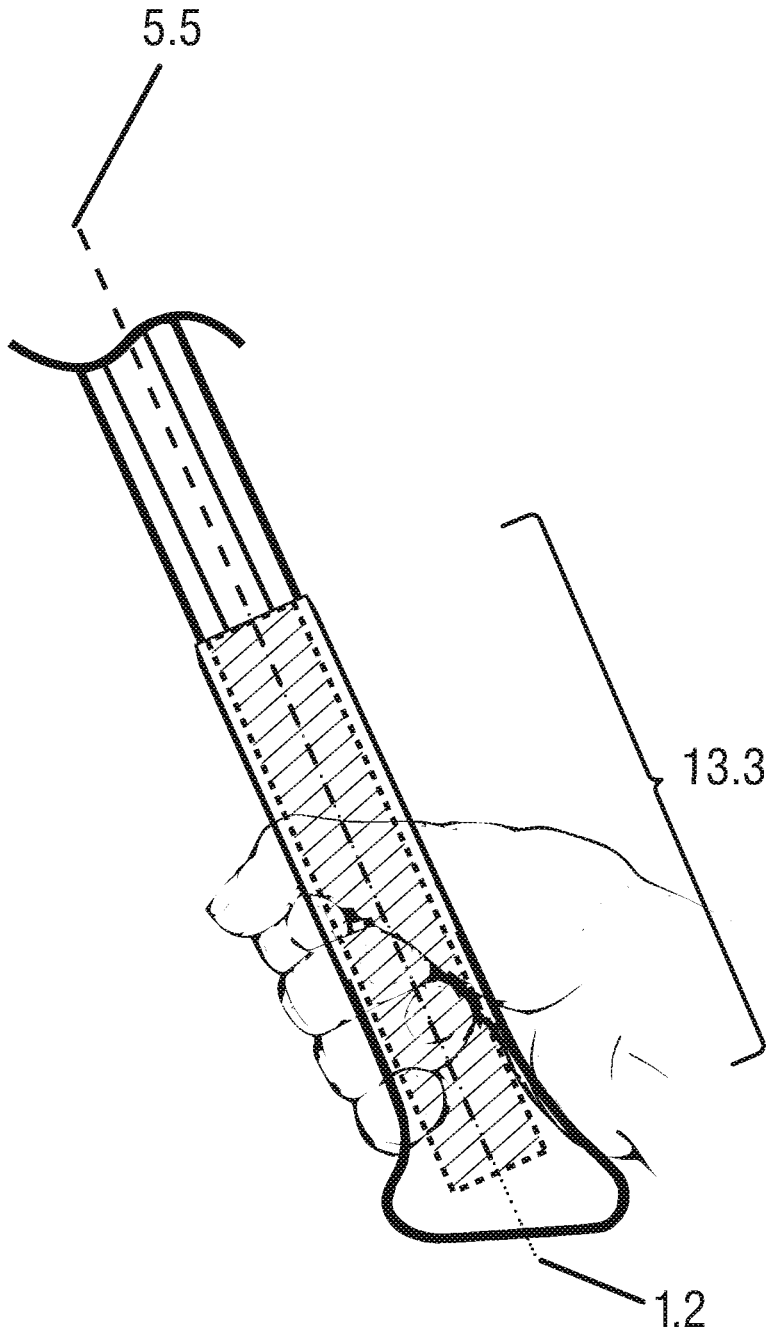
FIG. 13 is an enlarged, fragmentary, profile view of FIG. 12.

FIG. 13 shows in greater detail, the sleeve, gripping hand and fragmentary of the lacrosse stick from FIG. 12, wherein the lacrosse stick is fully inserted into the cavity of the sleeve. The central longitudinal axis of the sleeve, 1.2 is shown in parallel overlay, 13.3, with the central longitudinal axis of the hockey stick 5.5. Further, the external longitudinal surfaces of the lacrosse stick directly align with the external longitudinal surfaces of the neck of the sleeve providing a contiguous surface from stick to sleeve.

Figure 14:
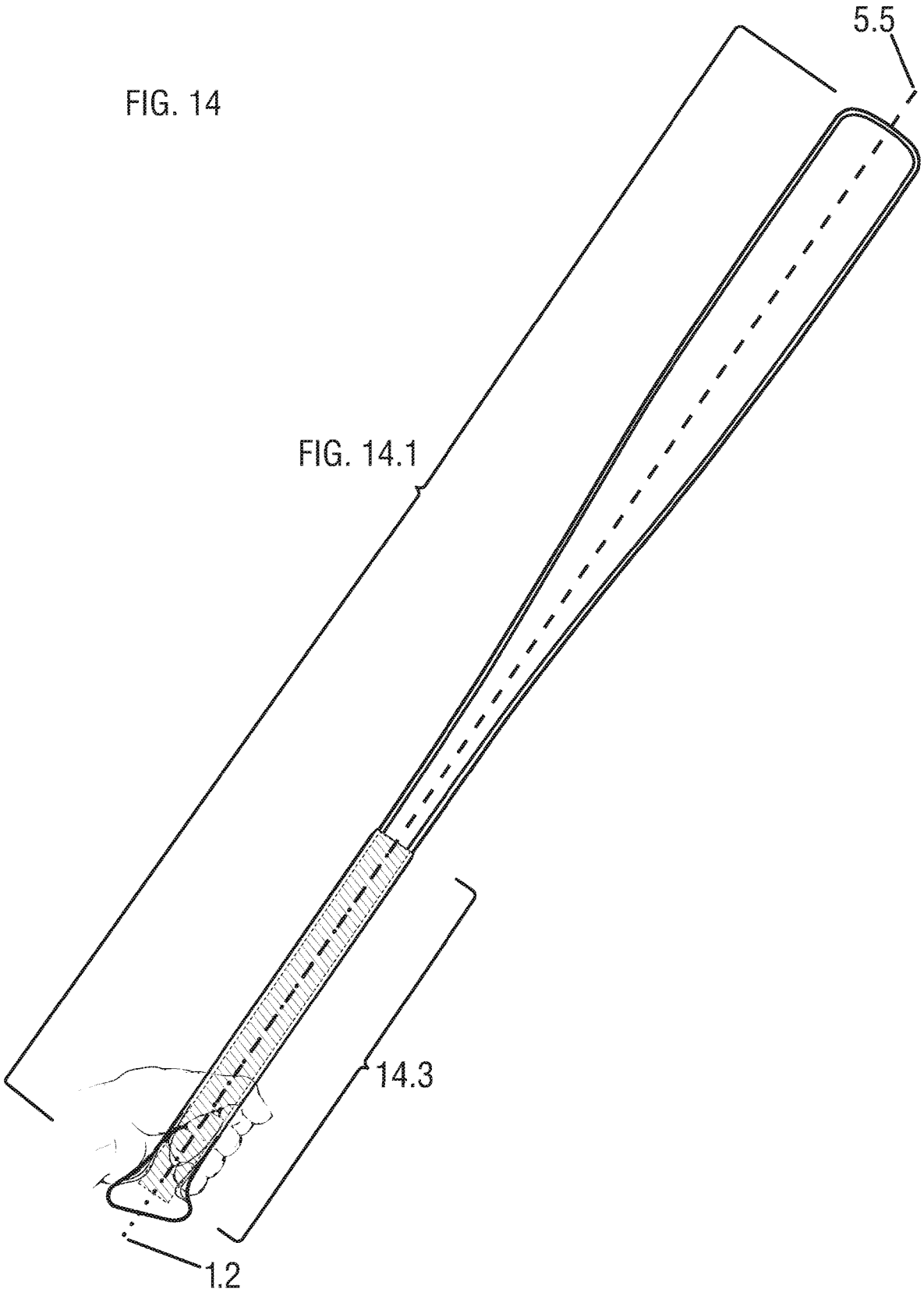
FIG. 14 is a profile view of a baseball bat with the embodiment of FIG. 1 applied to the handle end with a gripping hand.

FIG. 14 shows the handle of a bat fully inserted into the cavity of the sleeve, 14.1, being gripped by a gripping hand.

Figure 15:
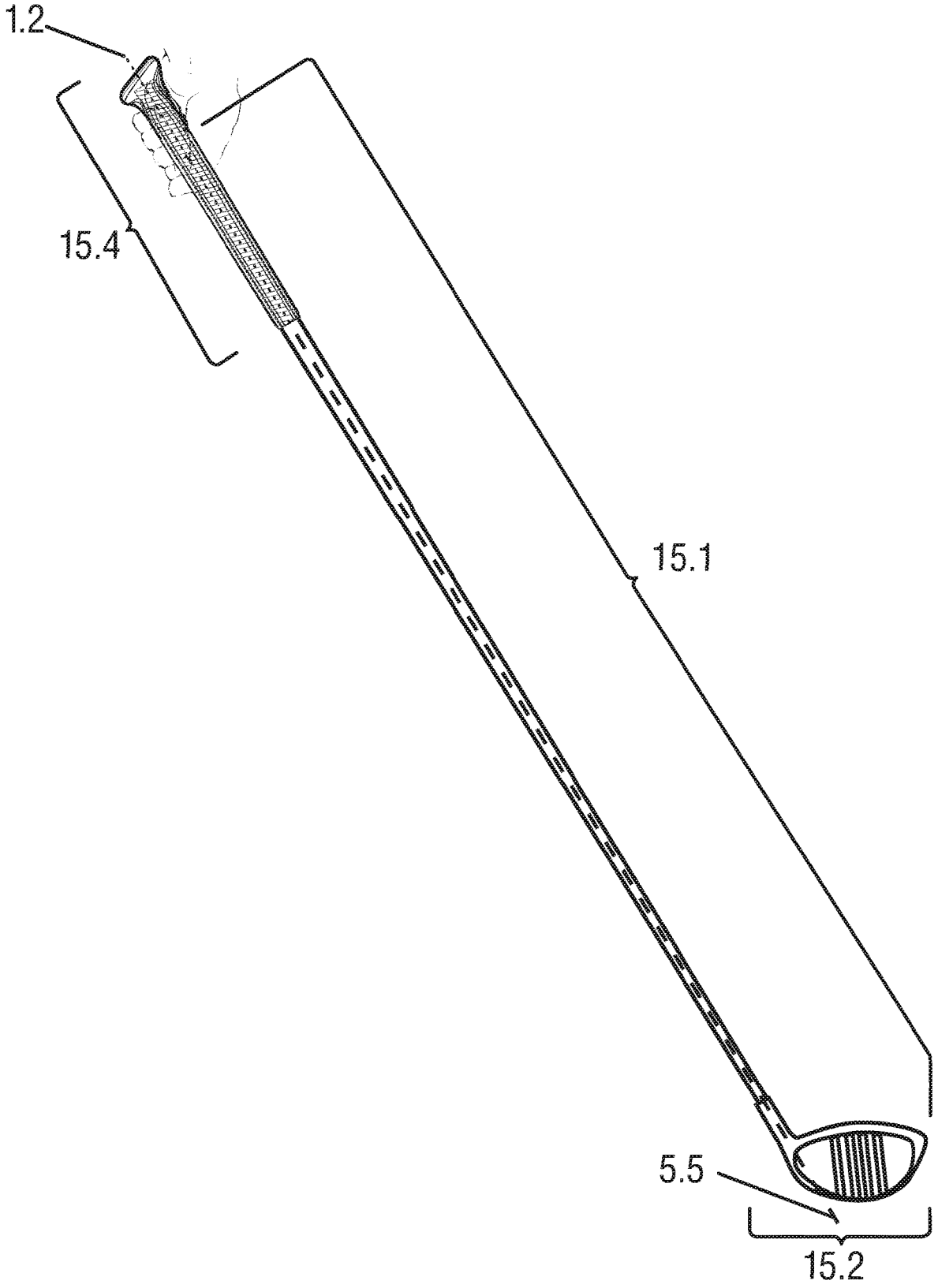
FIG. 15 is a profile view of a golf club with the embodiment of FIG. 1. Applied to the handle end with a gripping hand.

FIG. 15 shows the sleeve 15.4 of FIG. 1, with a handle end of a golf club fully inserted into the cavity of the sleeve being gripped by a gripping hand. The sleeve is affixed to the stick wherein the ventral cantle gripping structure of the sleeve is aligned on the same side of the cantle plane CP as the club head and the dorsal cantle region is on the opposite side of the cantle plane from the club head as shown 15.2.

Figure 16:
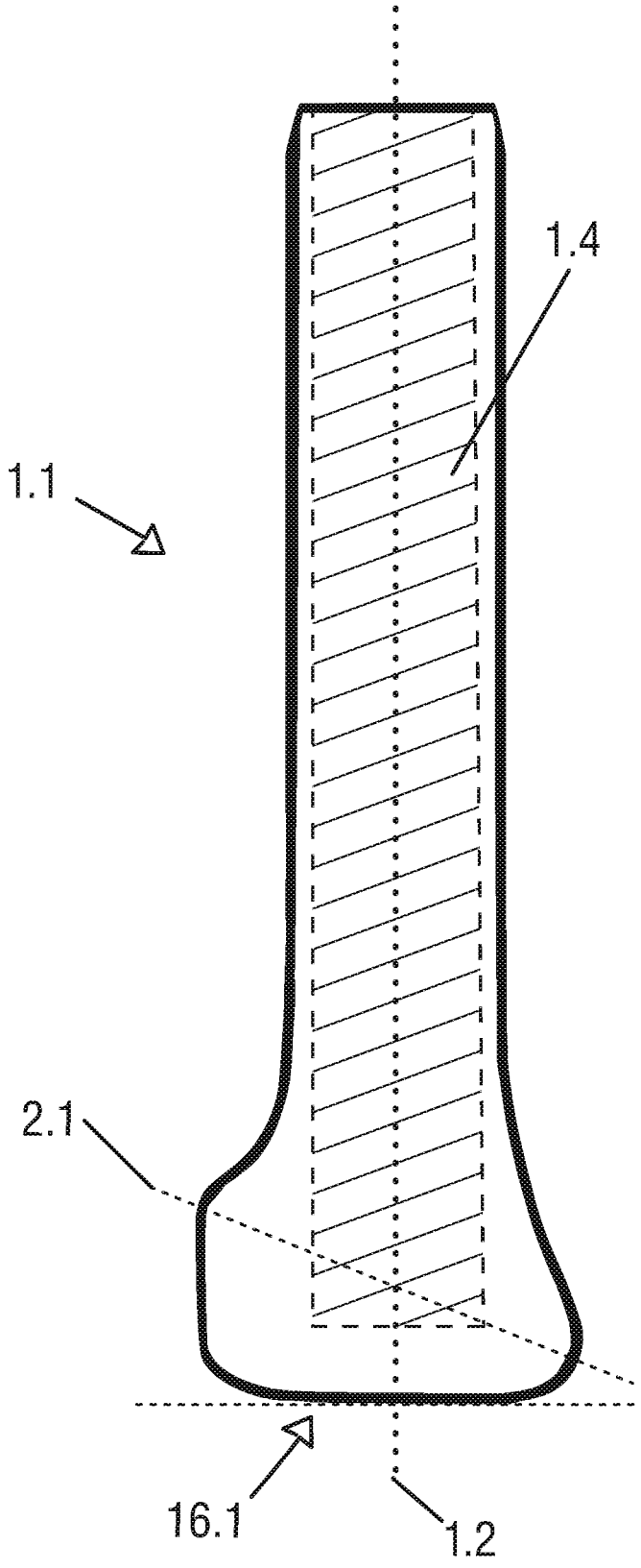
FIG. 16 is a profile view of the sleeve with support flange and neck for application with a sports stick with a flat butt end.

In yet another embodiment of the disclosure, as shown in FIG. 16, surface 16.1 of grip end is substantially perpendicular to central longitudinal axis 1.2. In this embodiment, grip end 1.5 is wedge shaped but the structure and features of neck 1.9, flange 1.8 (including ventral and dorsal cantle regions 5.1 and 5.2) and grip end 1.5 are as previously described in connection with FIGS. 1 and 2.

Figure 17:
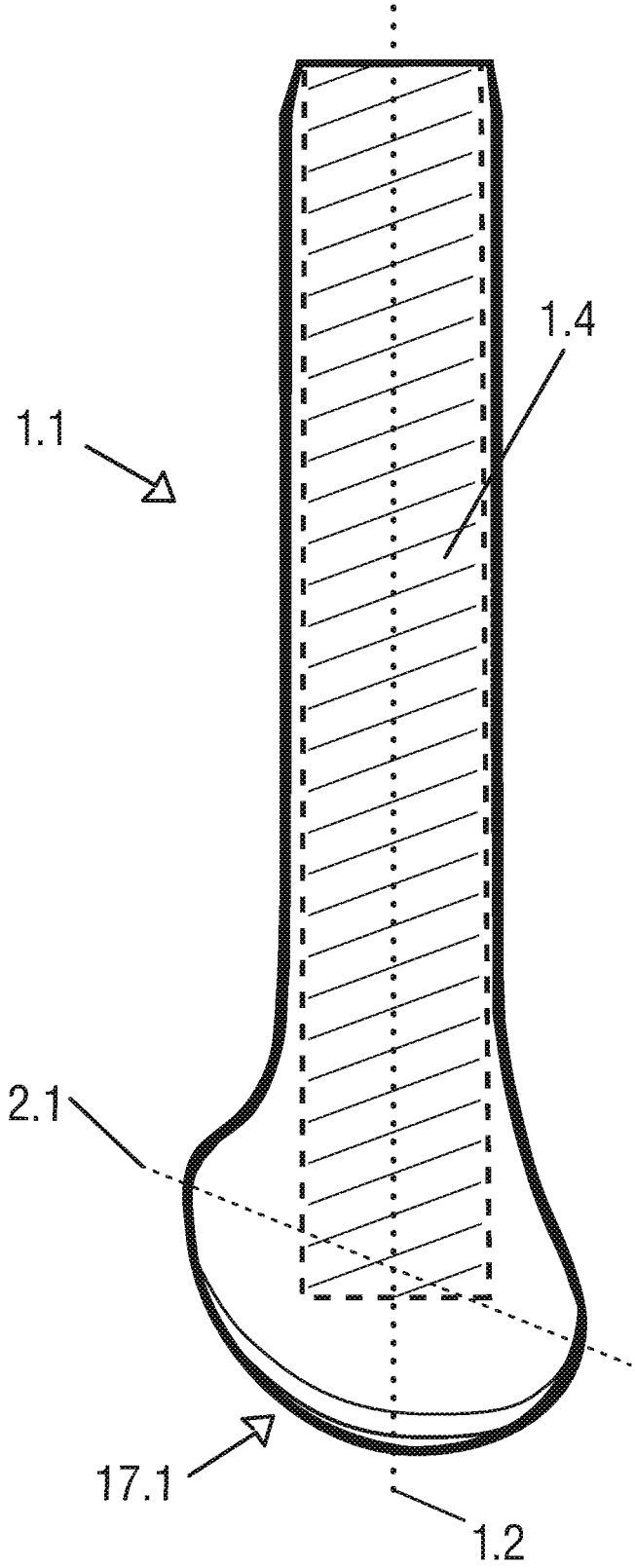
FIG. 17 is a profile view of the sleeve with support flange and neck for application with a sports stick with a rounded butt end.

In yet another embodiment of the disclosure, as shown in FIG. 17, surface 17.1 of grip end is substantially dome-shaped but the structure and features of neck 1.9, flange 1.8 (including ventral and dorsal cantle regions 5.1 and 5.2) and grip end 1.5 are as previously described in connection with FIGS. 1 and 2.

Figure 18:
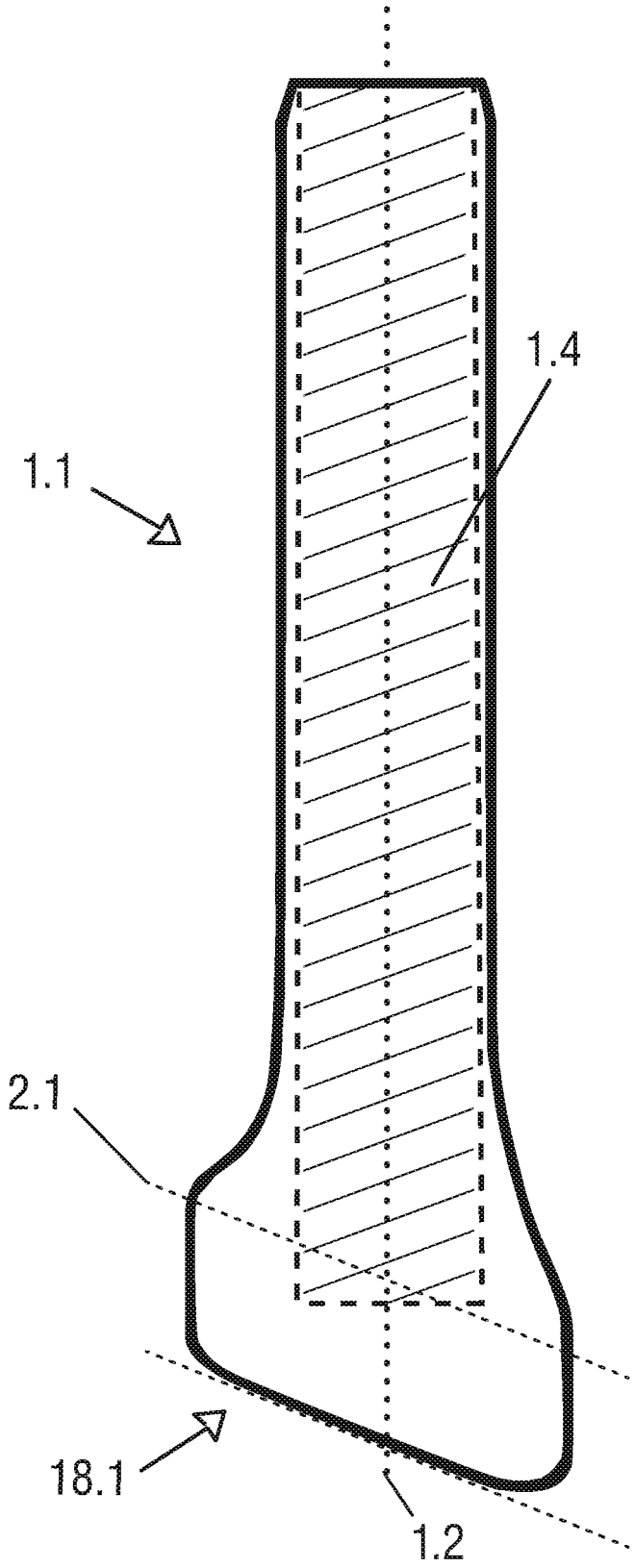
FIG. 18 is a profile view of the sleeve with support flange and neck for application with a sports stick with a thick gripping butt end.

In yet another embodiment of the disclosure, as shown in FIG. 18, surface 18.1 of grip end is substantially planar and disposed at an oblique angle relative to central longitudinal axis 1.2. In this embodiment, grip-end 1.5 is proportionately (relative to flange 1.8) larger than in certain other embodiments described herein but the structure and features of neck 1.9 and flange 1.8 (including ventral and dorsal cantle regions 5.1 and 5.2) are as previously described in connection with FIGS. 1 and 2.

Figure 19:
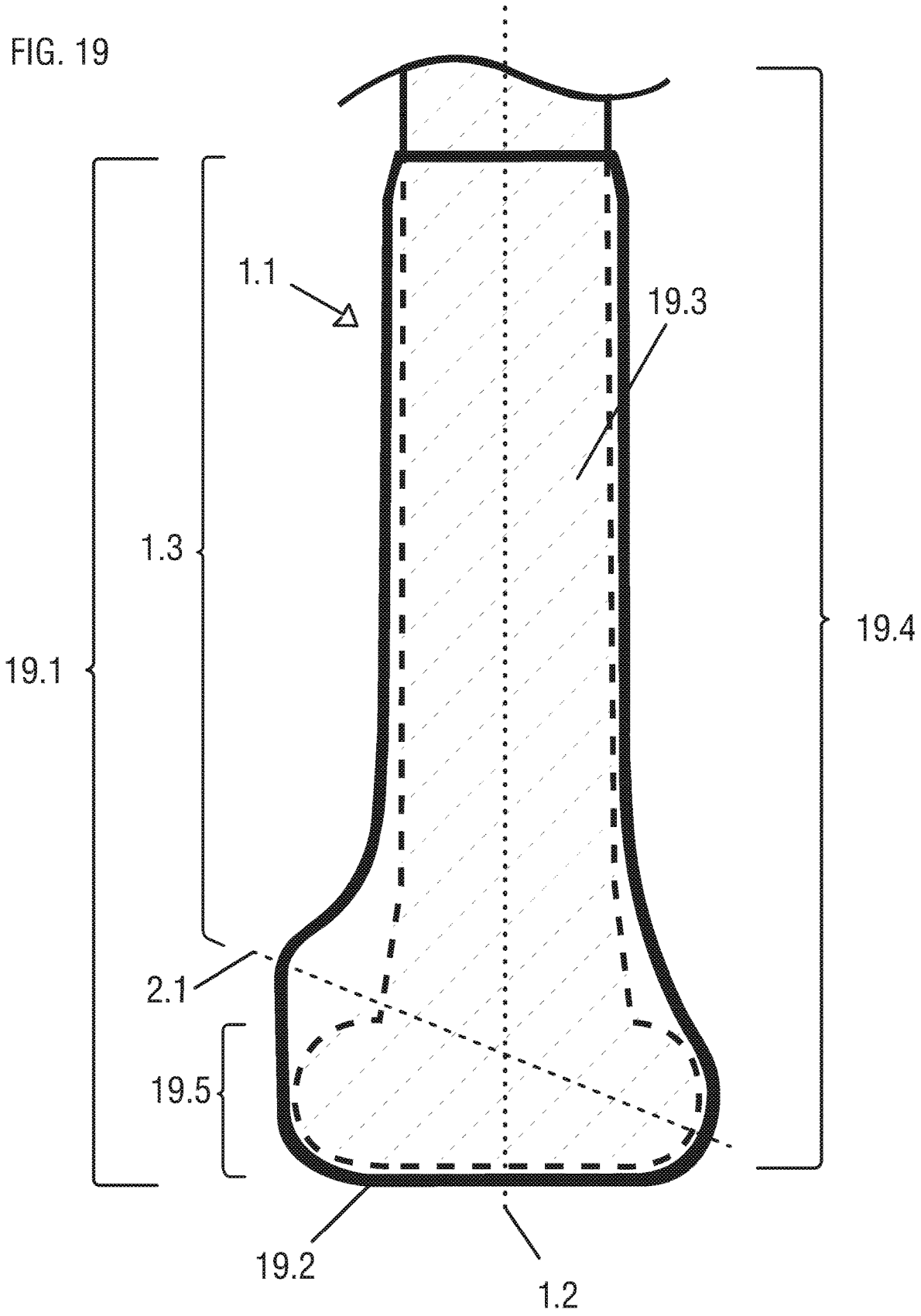
FIG. 19 is a profile view of the sleeve with support flange for application with a baseball bat shown in phantom.

In yet another embodiment of the disclosure, as shown in FIG. 19, a bat 19.4 is fully inserted into the cavity 19.3, which is internally shaped to accommodate the volume and shape of the sleeve of a bat, 19.5. Stated differently, sleeve 1.1 include space inside the cavity at the butt endward portion of the cavity, which allow a bat knob to be closely inserted and fitted such that the knob and portion of the handle of a bat is encapsulated inside a similar wedge shaped butt end as described in FIG. 16. In this embodiment, the structure and features of flange 1.8 (including ventral and dorsal cantle regions 5.1 and 5.2) and grip end 1.5 are as previously described in connection with FIGS. 1 and 2. Additionally, grip end 1.5 may possess any of the alternative shapes as described, for example, in connection with FIGS. 16, 17 and 18.

Figure 20:
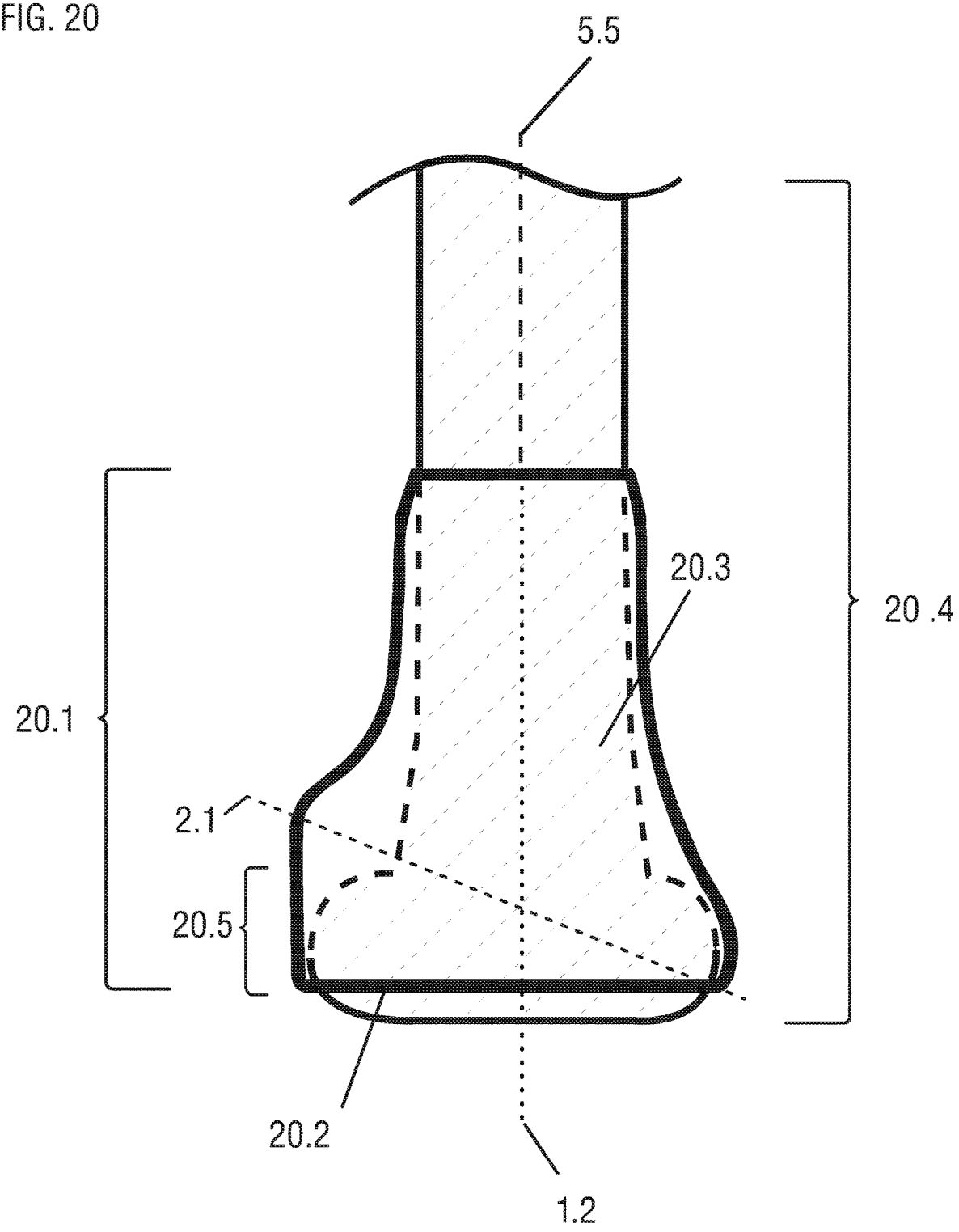
FIG. 20 is a profile view of the sleeve with support flange, short neck and open blunt end for application with a baseball bat shown in phantom.

In another embodiment of the present disclosure, referring now to FIG. 20, a variation of the embodiment of FIG. 19, the cavity 20.3 of the sleeve is open at the blunt end with a truncated neck portion, applied on the knob end of a baseball bat 20.4. In this embodiment, the structure and features of flange 1.8 (including ventral and dorsal cantle regions 5.1 and 5.2) and grip end 1.5 are as previously described in connection with FIGS. 1 and 2. FIG. 20 demonstrates the present disclosure without blunt end 1.7, without departing from the scope of the disclosure.

Figure 21:
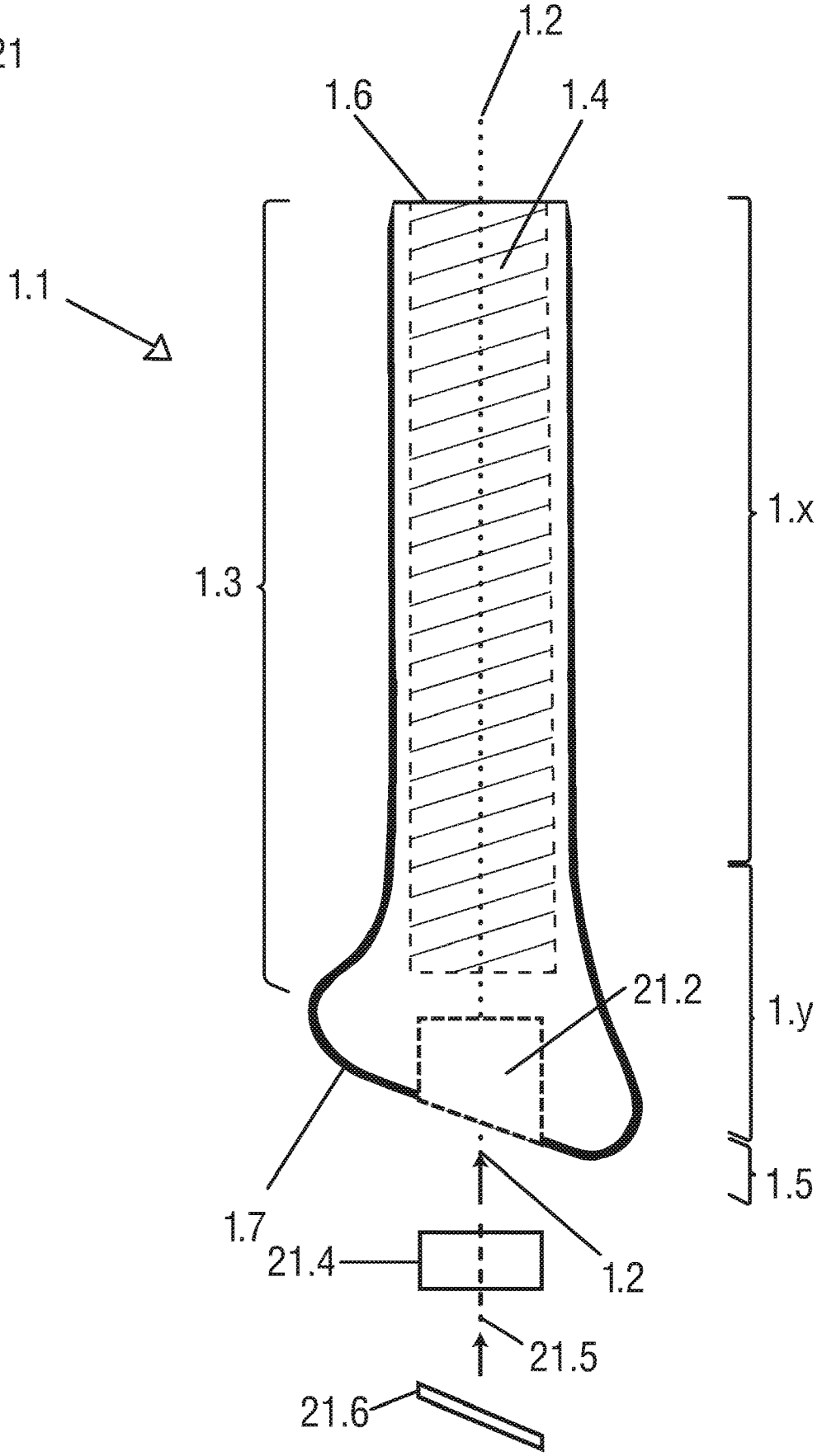
FIG. 21 is a profile view of FIG. 1 adapted with a cavity in the blunt end of the sleeve sized for housing a sensor.

In another embodiment of the present disclosure, and referring now to FIG. 21, sleeve 1.1 includes an internal cavity 21.2 in the blunt end 1.7 to accommodate an electronic device 21.4 such as an accelerometer or other electronic sensor to monitor an athlete's swing when the handle of the stick is fully inserted into cavity 1.4 such as a baseball bat (see, e.g., FIG. 14). In this embodiment, electronic device has a central axis 21.5 that is aligned with sleeve central longitudinal axis 1.2. The electronic device may be held by friction fit, adhesive, a mechanical fastener, and the like. Optionally, cavity 21.2 is enclosed by cover 21.6 after electronic device 21.4 is inserted into cavity. Exemplary electronic devices include Zepp brand electronic motion sensors sold by Zepp Labs (Los Gatos, Calif.) and those described in U.S. Pat. No. 8,725,452 (which is incorporated herein in its entirety).

In yet another embodiment of the disclosure, the cavity 1.4 at the butt end includes a plug 22.1 which, when a hollow handle of a stick is fully inserted into cavity 1.4, the plug is sized, in cross section to closely fit into the hollow opening at the end of the handle of the sports stick. This embodiment can also be constructed to include the cavity 21.2. This embodiment is applicable to all hollow sports sticks when fully inserted into the cavity 1.4 and provides increased stability and connection between the sleeve and the hollow sports stick.

Figure 22:
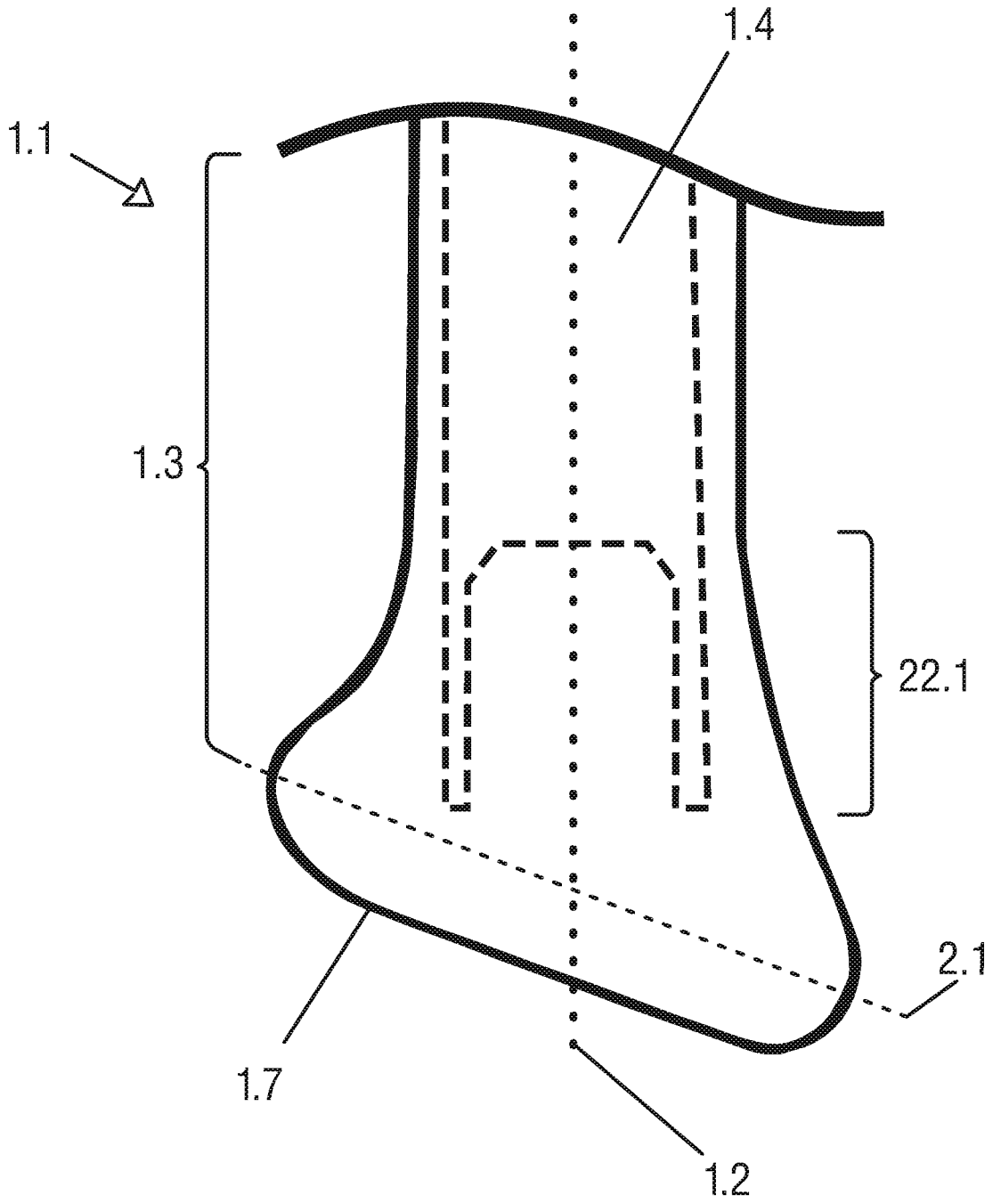
FIG. 22 is a fragmentary profile view of FIG. 1, adapted with an internal plug structure for insertion into the hollow gripping end of a sports stick.
Figure 23:
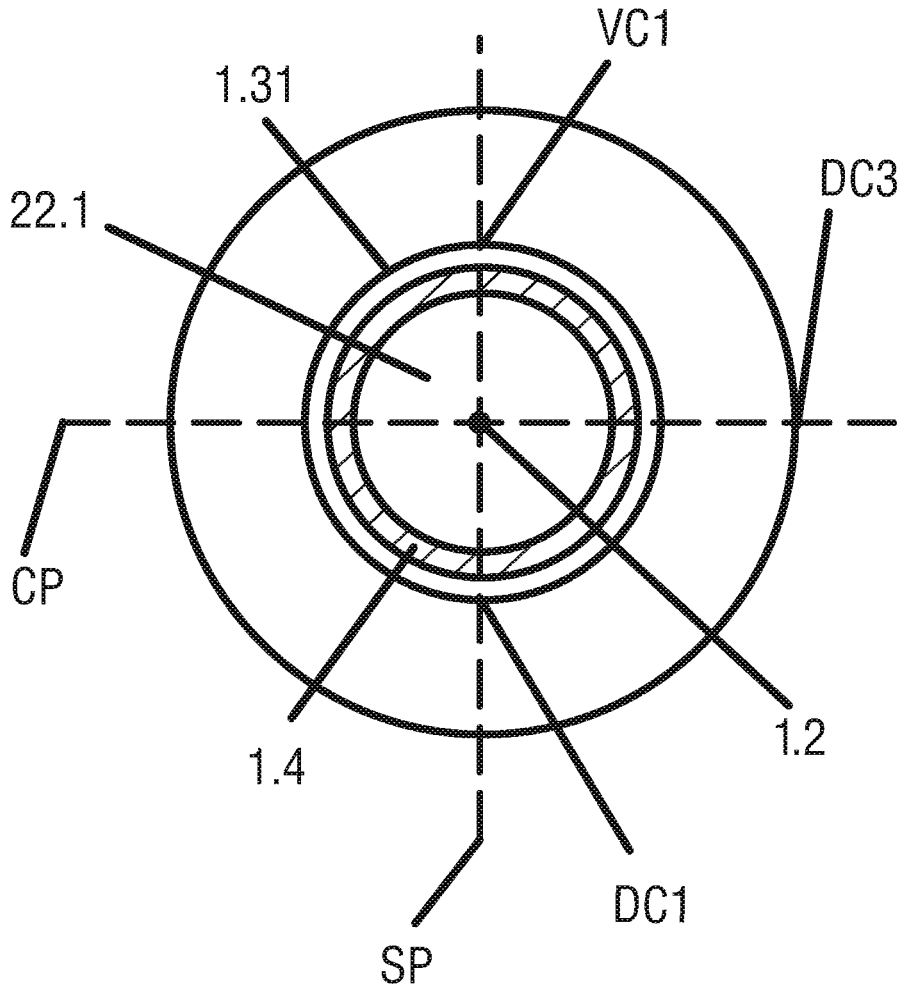
FIG. 23 is a top view of the sleeve for application with a round hollow stick.

FIG. 23 shows a top view of FIG. 22, configured for a round cross sectional hollow sports stick wherein the plug 22.1 is round in cross section.

The present disclosure further includes the following enumerated embodiments.

Embodiment 1

A sleeve adapted for receiving the solid or hollow end of a sports stick, the sleeve comprising a central longitudinal axis, a neck for receiving the end of the sports stick, a grip adapted for being grasped by the hand of an athlete, the grip comprising a grip end distal to the neck, a dorsal cantle region and a ventral cantle region, the dorsal and ventral cantle regions being between the neck and the grip end and on opposing sides of an imaginary coronal plane containing the central longitudinal axis and bisected by an imaginary sagittal plane that contains the central longitudinal axis and is orthogonal to the imaginary coronal plane, the dorsal and ventral cantle regions each providing a curved support surface for the hand of the athlete when the athlete is gripping the sports stick, the dorsal cantle region and the ventral cantle region each having a radius of curvature in the sagittal plane, the radius of curvature of the ventral cantle region being greater than the radius of curvature of the dorsal cantle region.

Embodiment 2

The sleeve of Embodiment 1 wherein a ratio of the radius of curvature of the ventral cantle region to the radius of curvature of the dorsal cantle region is at least 2:1, respectively.

Embodiment 3

The sleeve of Embodiment 1 wherein a ratio of the radius of curvature of the ventral cantle region to the radius of curvature of the dorsal cantle region is at least 3:1, respectively.

Embodiment 4

The sleeve of Embodiment 1 wherein a ratio of the radius of curvature of the ventral cantle region to the radius of curvature of the dorsal cantle region is at least 5:1, respectively.

Embodiment 5

The sleeve of any of Embodiments 1-4 wherein a ratio of the radius of curvature of the ventral cantle region to the radius of curvature of the dorsal cantle region is less than 20:1.

Embodiment 6

The sleeve of any of Embodiments 1-4 wherein a ratio of the radius of curvature of the ventral cantle region to the radius of curvature of the dorsal cantle region is less than 15:1, respectively.

Embodiment 7

The sleeve of any of Embodiments 1-4 wherein a ratio of the radius of curvature of the ventral cantle region to the radius of curvature of the dorsal cantle region is less than 10:1, respectively.

Embodiment 8

The sleeve of any of Embodiments 1-7 wherein the imaginary sagittal plane bisects each of the dorsal and the ventral cantle regions into symmetrical halves, respectively.

Embodiment 9

A sleeve adapted for receiving the end of a sports stick, the sleeve comprising a central longitudinal axis, a cavity for receiving the solid or hollow end of the sports stick, a grip adapted for being grasped by the hand of an athlete, the grip comprising a grip end distal to the cavity, a dorsal cantle region and a ventral cantle region, the dorsal and ventral cantle regions being between the cavity and the grip end and on opposing sides of an imaginary coronal plane containing the central longitudinal axis and bisected by an imaginary sagittal plane that contains the central longitudinal axis and is orthogonal to the imaginary coronal plane, the dorsal and ventral cantle regions each providing a curved support surface for the hand of the athlete when the athlete is gripping the sports stick, wherein the dorsal cantle region and ventral cantle region are asymmetric relative to each other about the coronal plane and the sagittal plane bisects each of the ventral and the dorsal cantle regions into symmetrical halves, respectively.

Embodiment 10

The sleeve of any of Embodiments 1-9 wherein the ventral cantle region smoothly transitions about the central longitudinal axis to the dorsal cantle region.

Embodiment 11

The sleeve of any of Embodiments 1-10 wherein the grip end has a circumference that is at least 110% of the circumference of the neck.

Embodiment 12

The sleeve of any of Embodiments 1-10 wherein the grip end has a circumference that is at least 150% of the circumference of the neck.

Embodiment 13

The sleeve of any of Embodiments 1-10 wherein the grip end has a circumference that is at least 200% of the circumference of the neck.

Embodiment 14

The sleeve of any of Embodiments 1-10 wherein the grip end has a circumference that is at least 300% of the circumference of the neck.

Embodiment 15

The sleeve of any of Embodiments 1-14 wherein the cavity has a length measured along the central longitudinal axis of about 2 to about 12 inches.

Embodiment 16

The sleeve of any of Embodiments 1-14 wherein the cavity has a length measured along the central longitudinal axis of about 2 to about 6 inches.

Embodiment 17

The sleeve of any of Embodiments 1-16 wherein the grip has a length, as measured along central longitudinal axis 1.2, that is about 5 to about 95% of the length of the sleeve and the cavity has a complementary length, as measured along the central longitudinal axis, that is about 95 to about 5% of the length of the sleeve.

Embodiment 18

The sleeve of any of Embodiments 1-16 wherein the grip has a length, as measured along central longitudinal axis 1.2, that is about 15 to about 85% of the length of the sleeve and the cavity has a complementary length, as measured along the central longitudinal axis, that is about 85 to about 15% of the length of the sleeve.

Embodiment 19

The sleeve of any of Embodiments 1-16 wherein the grip has a length, as measured along central longitudinal axis 1.2, that is about 25 to about 75% of the length of the sleeve and the cavity has a complementary length, as measured along the central longitudinal axis, that is about 75 to about 25% of the length of the sleeve.

Embodiment 20

The sleeve of any of Embodiments 1-16 wherein the grip has a length, as measured along central longitudinal axis 1.2, that is about 35 to about 65% of the length of the sleeve and the cavity has a complementary length, as measured along the central longitudinal axis, that is about 65 to about 35% of the length of the sleeve.

Embodiment 21

The sleeve of any of Embodiments 1-16 wherein the grip has a length, as measured along central longitudinal axis 1.2, that is about 40 to about 60% of the length of the sleeve and the cavity has a complementary length, as measured along the central longitudinal axis, that is about 60 to about 40% of the length of the sleeve.

Embodiment 22

The sleeve of any of Embodiments 1-21 wherein the grip comprises a neck between the flange and the cavity.

Embodiment 23

The sleeve of Embodiment 22 wherein the neck has a length measured along the central longitudinal axis of at least about 0.25 inches.

Embodiment 24

The sleeve of Embodiment 22 wherein the neck has a length measured along the central longitudinal axis in the range of about 0.25 to about 4 inches.

Embodiment 25

The sleeve of Embodiment 22 wherein the neck has a length measured along the central longitudinal axis in the range of about 1 to about 4 inches.

Embodiment 26

The sleeve of Embodiment 22 wherein the neck has a length measured along the central longitudinal axis in the range of about 1 to about 2 inches.

Embodiment 27

The sleeve of any of Embodiments 1-26 wherein the sleeve comprises a ceramic, metal, polymer, composite, wood or a composite or laminate thereof.

Embodiment 28

The sleeve of any of Embodiments 1-26 wherein the sleeve comprises a ceramic, metal, polymer, composite, or a composite or laminate thereof.

Embodiment 29

A combination of a sport stick and a sleeve, the sleeve corresponding to the sleeve of any of Embodiments 1-28 and being inserted into a hollow end of the sport stick.

Embodiment 30

The combination of Embodiment 29 wherein the sport stick is a hockey stick, a lacrosse stick, a golf club, or a baseball bat.

Embodiment 31

The combination of Embodiment 29 wherein the sport stick is a hockey stick, a lacrosse stick, or a golf club.

Embodiment 32

A combination of a hockey stick and a sleeve, the sleeve corresponding to the sleeve of any of Embodiments 1-28 and being inserted into a hollow end of the hockey stick wherein the ventral cantle region of sleeve is on the same side of the hockey stick as the blade of the hockey stick.

Embodiment 33

A combination of a lacrosse stick and a sleeve, the sleeve corresponding to the sleeve of any of Embodiments 1-28 and being inserted into a hollow end of the lacrosse stick wherein the ventral cantle region of sleeve is on the same side of the lacrosse stick as the net-side of the head of the lacrosse stick.

Embodiment 34

A combination of a golf club and a sleeve, the sleeve corresponding to the sleeve of any of Embodiments 1-28 and being inserted into a hollow end of the golf club wherein the ventral cantle region of sleeve and the head of the golf club are on the same side of the imaginary cantle plane and the dorsal cantle region and the head of the golf club are on opposite sides of the imaginary cantle plane.

Embodiment 35

A combination of a baseball bat and a sleeve, the sleeve corresponding to the sleeve of any of Embodiments 1-28 and being inserted into a hollow end of the baseball bat wherein the cavity has a circular cross-section.

Having described the disclosure in detail, it will be apparent that modifications and variations are possible without departing the scope of the disclosure defined in the appended claims.

What is claimed is:

1. A sleeve adapted for receiving a gripping end of a sports stick including a shaft having a central longitudinal axis, a contact surface at one end of the shaft and the gripping end at an opposing end of the shaft, the sleeve comprising:

a cavity into which the gripping end of the shaft is inserted;

a central longitudinal axis that is coincident with the shaft central longitudinal axis;

a neck;

a neck end;

a grip end being distal to the contact surface, the grip end having a planar bottom surface distal to the neck; and a flange being positioned between the neck and the grip end with the neck being proximate to the contact surface, wherein the flange includes a dorsal cantle region and a ventral cantle region, the dorsal and ventral cantle regions being between the neck and the grip end and on opposing sides of an imaginary coronal plane containing the central longitudinal axis and bisected by an imaginary sagittal plane that contains the sleeve central longitudinal axis and is orthogonal to the imaginary coronal plane, the dorsal and ventral cantle regions each providing a curved support surface, the dorsal cantle region and the ventral cantle region each having a radius of curvature in the sagittal plane, the radius of curvature of the ventral cantle region being greater than the radius of curvature of the dorsal cantle region, the ventral cantle region and the contact surface being on the same side of the imaginary coronal plane, the dorsal cantle region and the contact surface being on opposite sides of the imaginary coronal plane, and the neck having a gripping surface and a length with the neck extending from the neck end to the dorsal cantle region and the ventral cantle region with the gripping surface of the neck being equidistant from the central longitudinal axis along the length of the neck.

2. The sleeve of claim 1 wherein a ratio of the radius of curvature of the ventral cantle region to the radius of curvature of the dorsal cantle region is at least 3:1, respectively.

3. The sleeve of claim 1 wherein a ratio of the radius of curvature of the ventral cantle region to the radius of curvature of the dorsal cantle region is less than 10:1.

4. The sleeve of claim 1 wherein the imaginary sagittal plane bisects each of the dorsal and the ventral cantle regions into symmetrical halves, respectively and the imaginary coronal plane intersects with the imaginary sagittal plane at the central longitudinal axis in a center of the planar bottom surface.

5. The sleeve of claim 1 wherein the ventral cantle region smoothly transitions about the central longitudinal axis to the dorsal cantle region.

6. The sleeve of claim 1 wherein the neck has a circumference and the grip end has a circumference that is at least 150% of the circumference of the neck.

7. The sleeve of claim 1 wherein the cavity has a length measured along the sleeve central longitudinal axis of 2 inches to 12 inches.

8. The sleeve of claim 1 wherein the length of the neck measured along the sleeve central longitudinal axis is at least 0.25 inches.

9. The sleeve of claim 1 wherein the length of the neck measured along the sleeve central longitudinal axis is in the range of 1 inch to 14 inches.

10. The sleeve of claim 1 wherein the sleeve comprises a polymer.

11. A sports implement comprising a sports stick including a shaft having a central longitudinal axis, a contact surface at one end of the shaft and a gripping end at the opposing end of the shaft; and a sleeve comprising a cavity and into which the gripping end of the shaft is inserted, the sleeve further comprising a central longitudinal axis that is coincident with the shaft central longitudinal axis, a neck, a neck end, a grip end being distal to the contact surface, the grip end having a planar bottom surface distal to the neck, and a flange being between the neck and the grip end with the neck being proximate to the contact surface, the flange comprising a dorsal cantle region and a ventral cantle region, the dorsal and ventral cantle regions being between the neck and the grip end and on opposing sides of an imaginary coronal plane containing the central longitudinal axis and bisected by an imaginary sagittal plane that contains the sleeve central longitudinal axis and is orthogonal to the imaginary coronal plane, the dorsal and ventral cantle regions each providing a curved support surface, the dorsal cantle region and the ventral cantle region each having a radius of curvature in the sagittal plane, the radius of curvature of the ventral cantle region being greater than the radius of curvature of the dorsal cantle region, the ventral cantle region and the contact surface being on the same side of the imaginary coronal plane, the dorsal cantle region and the contact surface being on opposite sides of the imaginary coronal plane, the neck having a gripping surface and a length with the neck extending from the neck end to the dorsal cantle region and the ventral cantle region with the gripping surface of the neck being equidistant from the sleeve central longitudinal axis along the length of the neck.

12. The sports implement of claim 11 wherein a ratio of the radius of curvature of the ventral cantle region to the radius of curvature of the dorsal cantle region is at least 3:1 and less than 10:1, respectively.

13. The sports implement of claim 12 wherein the imaginary sagittal plane bisects each of the dorsal and the ventral cantle regions into symmetrical halves, respectively and the imaginary coronal plane intersects with the imaginary sagittal plane at the central longitudinal axis in a center of the planar bottom surface.

14. The sports implement of claim 13 wherein the ventral cantle region smoothly transitions about the central longitudinal axis to the dorsal cantle region.

15. The sports implement of claim 11 wherein the neck has a circumference and the grip end has a circumference that is at least 150% of the circumference of the neck.

16. The sports implement of claim 11 wherein the cavity has a length measured along the sleeve central longitudinal axis of 2 inches to 12 inches.

17. The sports implement of claim 11 wherein the length of the neck measured along the central longitudinal axis is in the range of 1 inch to 14 inches.

18. The sports implement of claim 11 wherein the sleeve comprises a polymer.

19. A sleeve adapted for receiving a gripping end of a sports stick including a shaft having a central longitudinal axis, a contact surface at one end of the shaft and the gripping end at an opposing end of the shaft, the sleeve comprising:

a cavity into which the gripping end of the shaft is inserted;

a central longitudinal axis that is coincident with the shaft central longitudinal axis;

a neck;

a neck end;

a grip end being distal to the contact surface, the grip end having a planar bottom surface distal to the neck; and a flange being positioned between the neck and the grip end with the neck being proximate to the contact surface, wherein the flange includes a dorsal cantle region and a ventral cantle region, the dorsal and ventral cantle regions being between the neck and the grip end and on opposing sides of an imaginary coronal plane containing the central longitudinal axis and bisected by an imaginary sagittal plane that contains the sleeve central longitudinal axis and is orthogonal to the imaginary coronal plane, the dorsal and ventral cantle regions each providing a curved support surface, the dorsal cantle region and the ventral cantle region each having a radius of curvature in the sagittal plane, the radius of curvature of the ventral cantle region being greater than the radius of curvature of the dorsal cantle region, at least one of the ventral cantle region or the dorsal cantle region being oriented perpendicularly to the contact surface, and the neck having a gripping surface and a length with the neck extending from the neck end to the dorsal cantle region and the ventral cantle region with the gripping surface of the neck being equidistant from the central longitudinal axis along the length of the neck.

20. The sleeve of claim 19 wherein a ratio of the radius of curvature of the ventral cantle region to the radius of curvature of the dorsal cantle region is at least 3:1, respectively.

* * * * *